US010034514B2

(12) United States Patent
Meschter et al.

(10) Patent No.: US 10,034,514 B2
(45) Date of Patent: Jul. 31, 2018

(54) ARTICLE OF FOOTWEAR WITH SOLE SYSTEM HAVING CARRIER MEMBER AND SENSORY NODE ELEMENTS

(71) Applicant: NIKE, Inc., Beaverton, OR (US)

(72) Inventors: James C. Meschter, Portland, OR (US); Kevin W. Hoffer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/061,259

(22) Filed: Mar. 4, 2016

(65) Prior Publication Data

US 2017/0251756 A1 Sep. 7, 2017

(51) Int. Cl.

| | |
|---|---|
| ***A43B 13/12*** | (2006.01) |
| ***A43B 13/18*** | (2006.01) |
| ***A43B 13/26*** | (2006.01) |
| ***A43B 17/00*** | (2006.01) |
| ***A43B 7/14*** | (2006.01) |
| ***A43B 13/14*** | (2006.01) |
| ***A43B 13/16*** | (2006.01) |

(52) U.S. Cl.

CPC ..... *A43B 13/181* (2013.01); *A43B 7/146* (2013.01); *A43B 13/12* (2013.01); *A43B 13/122* (2013.01); *A43B 13/145* (2013.01); *A43B 13/16* (2013.01); *A43B 13/187* (2013.01); *A43B 13/26* (2013.01); *A43B 17/00* (2013.01)

(58) Field of Classification Search

CPC ..... A43B 13/00; A43B 13/12; A43B 13/18; A43B 13/26; A43C 15/168; A43C 15/14

USPC ..... 36/25 R, 31, 30 R, 59 R, 61, 141, 67 R, 36/134

See application file for complete search history.

(56) References Cited

U.S. PATENT DOCUMENTS

| | | | | |
|---|---|---|---|---|
| 429,429 | A | 6/1890 | Eckhardt | |
| 4,060,917 | A | 12/1977 | Canale | |
| 4,747,220 | A * | 5/1988 | Autry | A43B 13/26 36/114 |
| RE33,066 | E | 9/1989 | Stubblefield | |
| 4,887,367 | A | 12/1989 | MacKness et al. | |
| 4,972,611 | A | 11/1990 | Swartz et al. | |
| 5,367,791 | A * | 11/1994 | Gross | A43B 13/26 36/25 R |

(Continued)

FOREIGN PATENT DOCUMENTS

| | | |
|---|---|---|
| CN | 201595237 U | 10/2010 |
| EP | 1369048 | 12/2003 |

(Continued)

OTHER PUBLICATIONS

International Search Report and Written Opinion, dated Jun. 1, 2017, for corresponding International Patent Application No. PCT/US2017/019167, 16 pages.

(Continued)

*Primary Examiner* — Marie Bays

(74) *Attorney, Agent, or Firm* — Klarquist Sparkman, LLP

(57) ABSTRACT

An article of footwear includes a sole system with a carrier member and a plurality of sensory node elements. The sensory node elements are received in recesses of the carrier member and can protrude through to the upper and/or an insole. The sensory node elements push against the foot to increase sensory perception of the surface underlying the sole system.

18 Claims, 24 Drawing Sheets

(56) References Cited

U.S. PATENT DOCUMENTS 5,377,431 A * 1/1995 Walker ..... A43C 15/162 36/134
D397,237 S 8/1998 Teague
5,926,974 A * 7/1999 Friton ..... A43B 13/26 36/28
D448,919 S 10/2001 Montross et al.
D453,872 S 2/2002 White
6,481,122 B2 * 11/2002 Brahler ..... A43C 15/165 36/127
6,698,110 B1 * 3/2004 Robbins ..... A43B 5/185 36/134
6,739,075 B2 * 5/2004 Sizemore ..... A43B 13/182 36/61
7,069,672 B2 7/2006 Hahn
7,140,129 B2 11/2006 Clarke et al.
7,313,875 B2 1/2008 Morgan
D570,584 S 6/2008 Gay
7,430,819 B2 * 10/2008 Auger ..... A43C 15/14 36/134
7,523,566 B2 * 4/2009 Young-Chul ..... A43B 13/12 36/28
7,549,236 B2 6/2009 Dillon et al.
7,681,333 B2 3/2010 Clark et al.
7,882,648 B2 2/2011 Langvin
7,954,257 B2 * 6/2011 Banik ..... A43B 7/144 36/28
7,966,748 B2 6/2011 Votolato
8,074,376 B1 12/2011 Teteriatnikov
8,079,160 B2 * 12/2011 Baucom ..... A41D 13/065 36/61
D652,614 S 1/2012 Raysse
8,256,145 B2 * 9/2012 Baucom ..... A43B 1/0018 36/61
8,341,855 B2 1/2013 Teteriatnikov
8,656,610 B2 * 2/2014 Baucom ..... A41D 13/065 36/61
D708,831 S 7/2014 Petrie
8,763,276 B2 7/2014 Greene et al.
8,763,277 B2 7/2014 Sartor
D719,329 S 12/2014 Smith
8,914,993 B2 12/2014 Hay et al.
D723,773 S 3/2015 Raysee
D723,774 S 3/2015 Raysse
D723,788 S 3/2015 Raysse
8,984,771 B1 * 3/2015 Kramer ..... A43B 13/14 36/28
9,144,264 B2 9/2015 Marvin et al.
9,161,591 B2 10/2015 Shrairman et al.
9,516,917 B2 * 12/2016 Hoffer ..... A43B 13/122
9,516,918 B2 * 12/2016 Meschter ..... A43B 13/18
2002/0078598 A1 6/2002 Bell
2005/0188562 A1 9/2005 Clarke et al.
2005/0217148 A1 10/2005 Connolly et al.
2007/0277401 A1 * 12/2007 Young-Chul ..... A43B 13/12 36/30 R
2009/0038180 A1 2/2009 Jacob
2009/0044432 A1 2/2009 O'Connor et al.
2010/0077635 A1 * 4/2010 Baucom ..... A41D 13/065 36/61
2011/0072684 A1 3/2011 Stubblefield
2011/0126422 A1 6/2011 Vattes et al.
2011/0138657 A1 6/2011 Christensen
2011/0192056 A1 * 8/2011 Geser ..... A43C 15/14 36/114
2012/0073160 A1 3/2012 Marvin et al.
2012/0291315 A1 * 11/2012 Baucom ..... A43B 1/0018 36/134
2013/0212909 A1 8/2013 Bates et al.
2014/0013617 A1 1/2014 Montross et al.
2014/0310995 A1 * 10/2014 Campari ..... A43C 15/161 36/134
2014/0325871 A1 11/2014 Price et al.
2015/0068063 A1 3/2015 Farris
2015/0128455 A1 5/2015 Lubart
2015/0143714 A1 5/2015 Tzeng
2015/0157089 A1 6/2015 Schumacher et al.
2015/0196082 A1 7/2015 Van Atta
2015/0196087 A1 * 7/2015 Meschter ..... A43B 13/18 36/25 R
2015/0208753 A1 7/2015 Dua et al.
2015/0272271 A1 10/2015 Campos, II et al.
2015/0282561 A1 10/2015 Swager
2015/0313310 A1 11/2015 Okamoto et al.
2016/0192739 A1 * 7/2016 Hoffer ..... A43B 13/122 36/28
2016/0360829 A1 * 12/2016 Meschter ..... A43B 13/18
2017/0006963 A1 * 1/2017 Hoffer ..... A43B 13/122

FOREIGN PATENT DOCUMENTS

JP H05115308 A 5/1993
KR 10-0870929 B1 11/2008
WO WO 2006/127427 11/2006
WO WO 2015/108593 7/2015

OTHER PUBLICATIONS

Screenshot of website https://www.youtube.com/watch?v=0Njve1rhPG8 titled "Skechers GOwalk 3 Commercial," which is identified as "Published on Jan. 19, 2015."
Office Action, dated Dec. 20, 2017, from related Taiwanese Patent Application No. 106106965, 24 pages (with English translation).

* cited by examiner

ARTICLE OF FOOTWEAR WITH SOLE SYSTEM HAVING CARRIER MEMBER AND SENSORY NODE ELEMENTS

BACKGROUND

The present embodiments relate generally to articles of footwear, and in particular to articles of footwear that improve sensory perception in the foot for a user.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

SUMMARY

In one embodiment, an article of footwear with an upper and a sole system includes a plurality of sensory node elements including a first sensory node element and a second sensory node element. The first sensory node element has a first bottom end configured to contact a ground surface and a first top end disposed opposite the first bottom end, and the second sensory node element has a second bottom end configured to contact a ground surface and a second top end disposed opposite the second bottom end. The sole system also includes a carrier member for the plurality of sensory node elements, the carrier member including a plurality of recesses, where the plurality of recesses includes a first recess corresponding with the first top end of the first sensory node element and where the plurality of recesses includes a second recess corresponding with the second top end of the second sensory node element. The first top end of the first sensory node element has a smaller diameter than the first bottom end, and the second top end of the second sensory node element has a smaller diameter than the second bottom end. The first recess is spaced apart from the second recess. The first sensory node element can tilt about a first central axis of the first recess, and the second sensory node element can tilt about a second central axis of the second recess.

An article of footwear includes a sole structure including a plurality of sensory node elements and a carrier member for the plurality of sensory node elements. The plurality of sensory node elements includes a first sensory node element and a second sensory node element. The first sensory node element has a first bottom end configured to contact a ground surface and a first top end disposed opposite the first bottom end. The second sensory node element has a second bottom end configured to contact a ground surface and a second top end disposed opposite the second bottom end. The carrier member includes a plurality of recesses, where the plurality of recesses includes a first recess corresponding with the first top end of the first sensory node element and where the plurality of recesses includes a second recess corresponding with the second top end of the second sensory node element. The first top end of the first sensory node element has a smaller diameter than the first bottom end, and the second top end of the second sensory node element has a smaller diameter than the second bottom end. The article also includes an inner foot-receiving layer. The carrier system is located between the inner foot-receiving layer and the plurality of sensory node elements.

An article of footwear includes a sole structure including a plurality of sensory node elements and a carrier member for the plurality of sensory node elements. The plurality of sensory node elements including a first sensory node element and a second sensory node element. The first sensory node element has a first bottom end configured to contact a ground surface and a first top end disposed opposite the first bottom end, and the second sensory node element has a second bottom end configured to contact a ground surface and a second top end disposed opposite the second bottom end. The first top end of the first sensory node element has a smaller diameter than the first bottom end, and the second top end of the second sensory node element has a smaller diameter than the second bottom end. The carrier member includes a base portion with a plurality of recesses, where the plurality of recesses includes a first recess corresponding with the first top end of the first sensory node element and where the plurality of recesses includes a second recess corresponding with the second top end of the second sensory node element. The carrier member further includes a side portion extending from a perimeter of the base portion.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
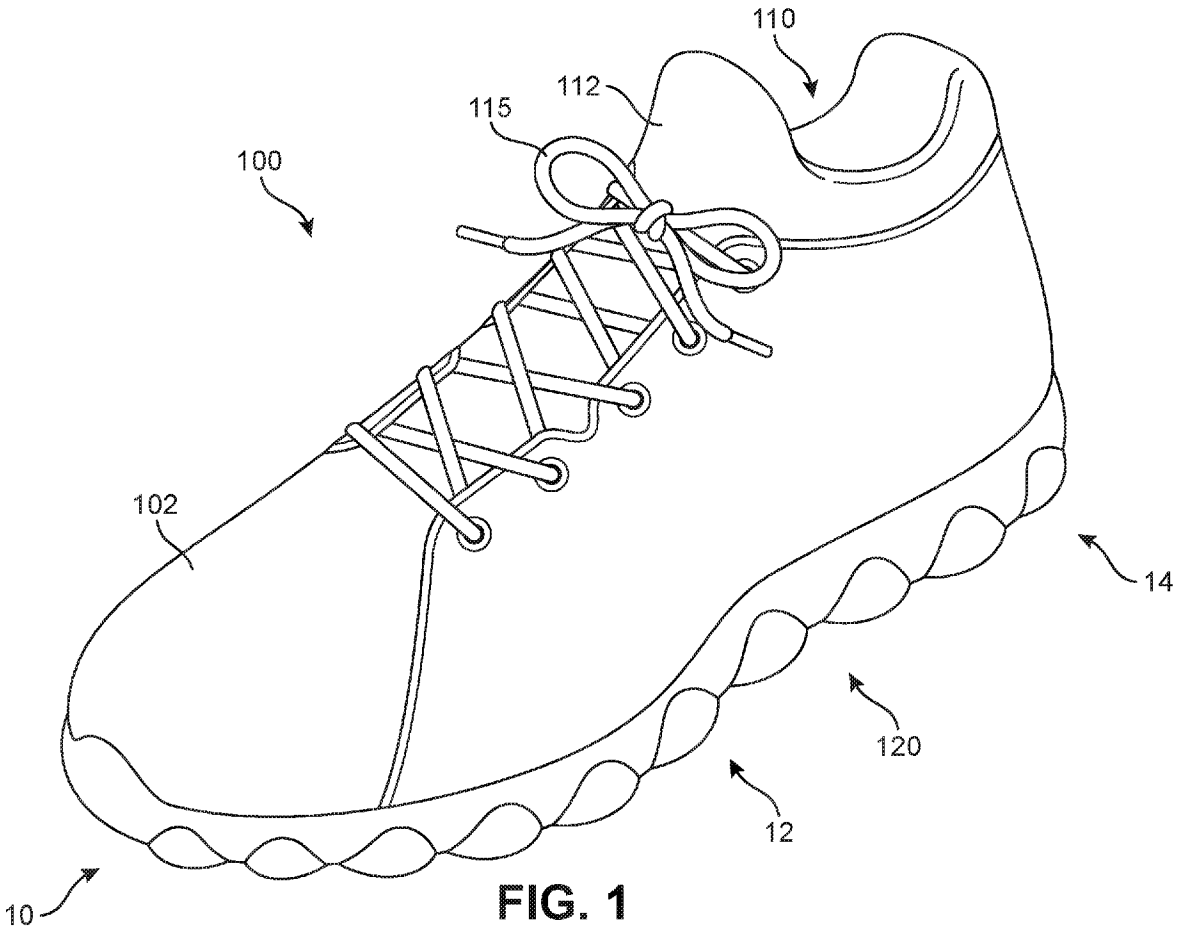
FIG. 1 is a schematic view of an embodiment of an article of footwear.
Figure 2:
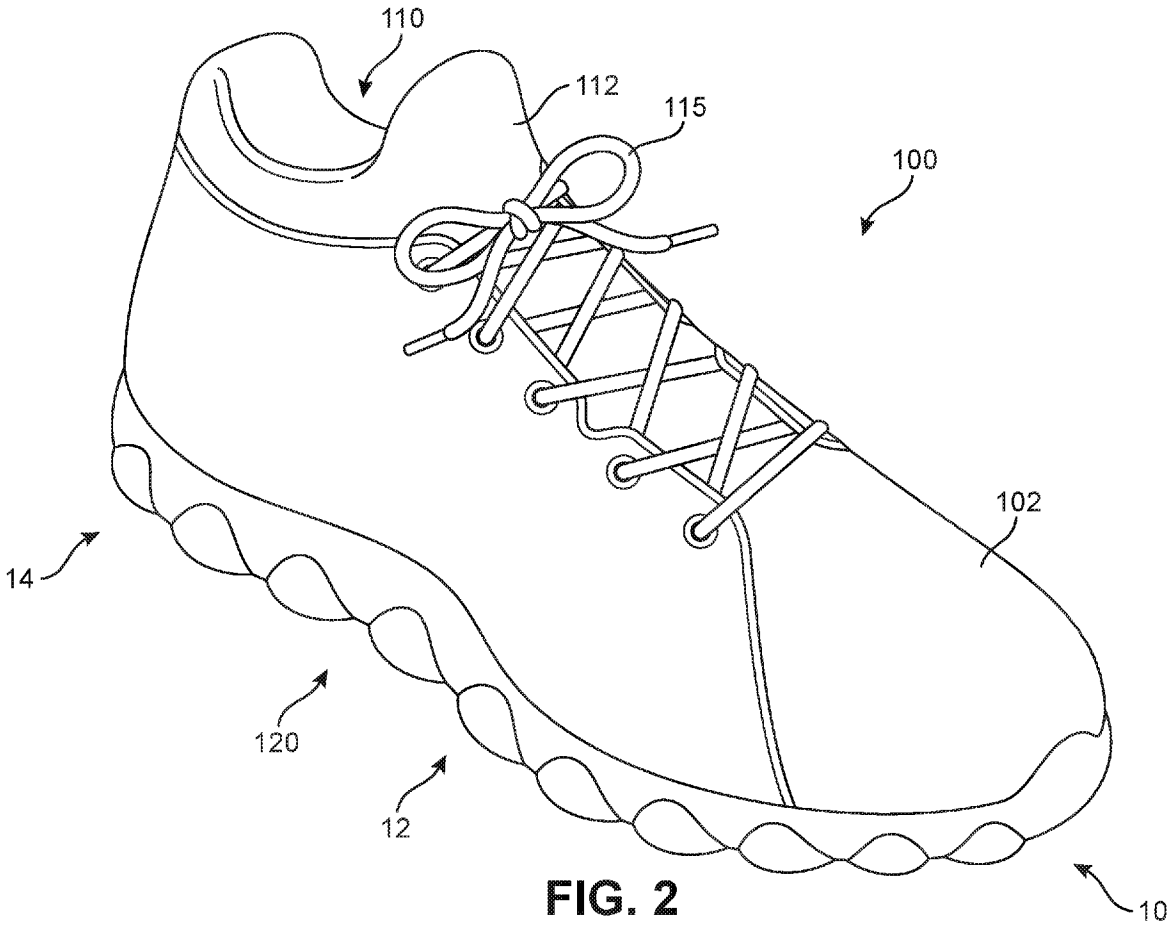
FIG. 2 is a schematic view of an opposing side of the article of footwear of FIG. 1.

FIGS. 1-2 depict isometric views of an embodiment of article of footwear 100, also referred to simply as article 100. For purposes of illustration, the exemplary embodiment depicts article 100 having a particular type and style. However, it may be understood that the features described herein could be incorporated into a wide variety of different article types, each having various possible styles (or designs). That is, in other embodiments, the principles discussed herein could be employed in any kind of article of footwear including, but not limited to, basketball shoes, hiking boots, soccer shoes, football shoes, sneakers, running shoes, cross-training shoes, rugby shoes, baseball shoes as well as other kinds of shoes. Moreover, in some embodiments, the provisions discussed herein for the various articles could be incorporated into various other kinds of non-sports-related footwear, including, but not limited to, slippers, sandals, high-heeled footwear, and loafers.

For purposes of clarity, the embodiment depicts a single article of footwear for use on a left foot. However, it will be understood that other embodiments may incorporate a corresponding article of footwear (e.g., a corresponding right shoe in a pair) that may share some, and possibly all, of the features of the various articles described herein and shown in the figures.

The embodiments may be characterized by various directional adjectives and reference portions. These directions and reference portions may facilitate in describing the portions of a sole system and/or more generally an article of footwear, either of which may be referred to more generally as a component.

For consistency and convenience, directional adjectives are employed throughout this detailed description corresponding to the illustrated embodiments. The term "longitudinal" as used throughout this detailed description and in the claims refers to a direction oriented along a length of a component (e.g., a sole structure). In some cases, a longitudinal direction may be parallel to a longitudinal axis that extends between a forefoot portion and a heel portion of the component. Also, the term "lateral" as used throughout this detailed description and in the claims refers to a direction oriented along a width of a component. In some cases, a lateral direction may be parallel to a lateral axis that extends between a medial side and a lateral side of a component. Furthermore, the term "vertical" as used throughout this detailed description and in the claims refers to a direction generally perpendicular to a lateral and longitudinal direction. For example, in cases where an article is planted flat on a ground surface, a vertical direction may extend from the ground surface upward. Additionally, the term "inner" refers to a portion of a component disposed closer to an interior of an article, or closer to a foot when the article is worn. Likewise, the term "outer" refers to a portion of a component disposed further from the interior of the article or from the foot. Thus, for example, the inner surface of a component is disposed closer to an interior of the article than the outer surface of the component. This detailed description makes use of these directional adjectives in describing an article and various components of a sole system.

An article, as well as a subcomponent of the article such as a sole system, may be broadly characterized by a number of different regions or portions. For example, a sole system could include a forefoot region, a midfoot region, and a heel region. A forefoot region of a sole structure may be generally associated with the toes and joints connecting the metatarsals with the phalanges in the foot. A midfoot region may be generally associated with the arch of a foot. Likewise, a heel region may be generally associated with the heel of a foot, including the calcaneus bone. In addition, a sole system may include a lateral side and a medial side. In particular, the lateral side and the medial side may be opposing sides of a sole system. As used herein, the terms forefoot region, midfoot region, and heel region as well as the lateral side and medial side are not intended to demarcate precise areas of a sole system (or more broadly, of an article). Rather, these regions and sides are intended to represent general areas of the sole system that provide a frame of reference during the following discussion. In the embodiment depicted in FIGS. 1-2, article 100 includes forefoot region 10, midfoot region 12, and heel region 14.

Embodiments in the figures depict upper 102 that is attached with sole system 120 to form a full article of footwear. Generally, it may be understood that the embodiments are not limited to any type of upper, and properties of any upper could be varied accordingly in other embodiments. An upper could be formed from a variety of different manufacturing techniques, resulting in various kinds of upper structures. For example, in some embodiments, an upper could have a braided construction, a knitted (e.g., warp-knitted) construction, or some other woven construction. Moreover, in some embodiments, an upper may have a construction wherein a bottom side or surface of the upper is closed and thereby provides 360 degree coverage for at least some portions of a foot. In other embodiments, however, an upper may be open on a lower side. In some such embodiments, a strobel layer, liner, insole, or other component may be placed within the upper cavity to receive a foot instead of having the foot received directly onto a midsole or other sole component. As an example, some embodiments may use an upper with a closed lower surface (i.e., a bootie-like upper).

In some embodiments, an upper may include various other provisions to facilitate insertion of a foot as well as for tightening the upper around an inserted foot. In FIGS. 1-2, upper 102 may include a variety of provisions for receiving and covering a foot, as well as securing article 100 to the foot. In some embodiments, upper 102 includes opening 110 that provides entry for the foot into an interior cavity of upper 102. In some embodiments, upper 102 may include tongue 112 that provides cushioning and support across the instep of the foot. Some embodiments may include fastening provisions, including, but not limited to, laces, cables, straps, buttons, zippers as well as any other provisions known in the art for fastening articles. In some embodiments, lace 115 may be applied at a fastening region of upper 102.

Generally, a sole system may be configured to provide various functional properties for an article, including, but not limited to, providing traction/grip with a ground surface as well as attenuating ground reaction forces when compressed between the foot and the ground during walking, running, or other ambulatory activities (e.g., providing cushioning). The configuration of a sole system may vary significantly in different embodiments to include a variety of conventional or non-conventional structures. In some cases, the configuration of a sole system can be configured according to one or more types of ground surfaces on which the sole structure may be used. Examples of ground surfaces include, but are not limited to, natural turf, synthetic turf, dirt, hardwood flooring, as well as other surfaces.

In some embodiments, a sole system can include provisions that increase sensory perception along one or more portions of a foot. For example, in some embodiments, a sole system can include one or more sensory node elements that can provide tactile feedback to a foot as a user walks, runs, or performs other athletic activities.

Figure 3:
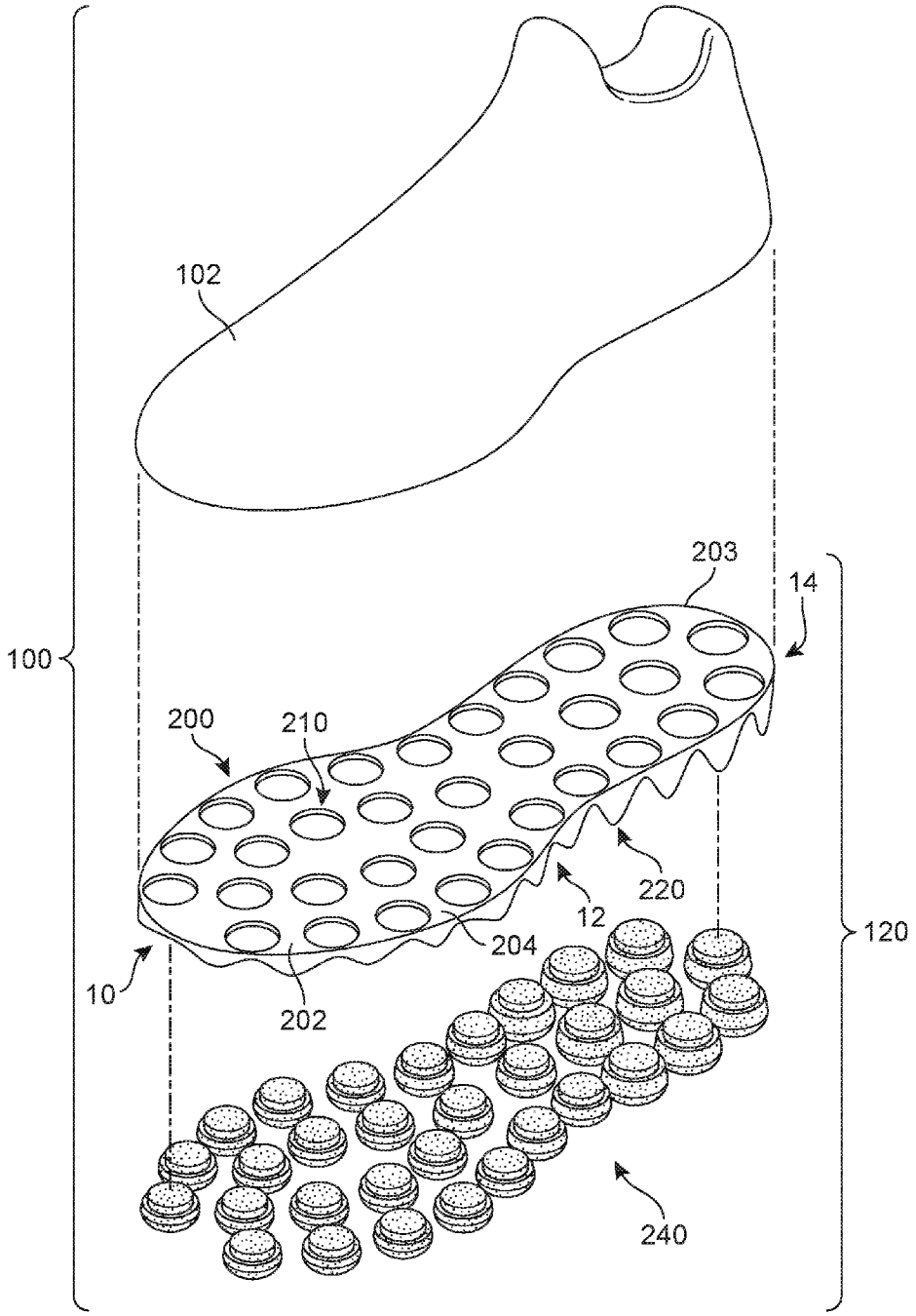
FIG. 3 is a schematic exploded view of an article of footwear with a sole system.
Figure 4:
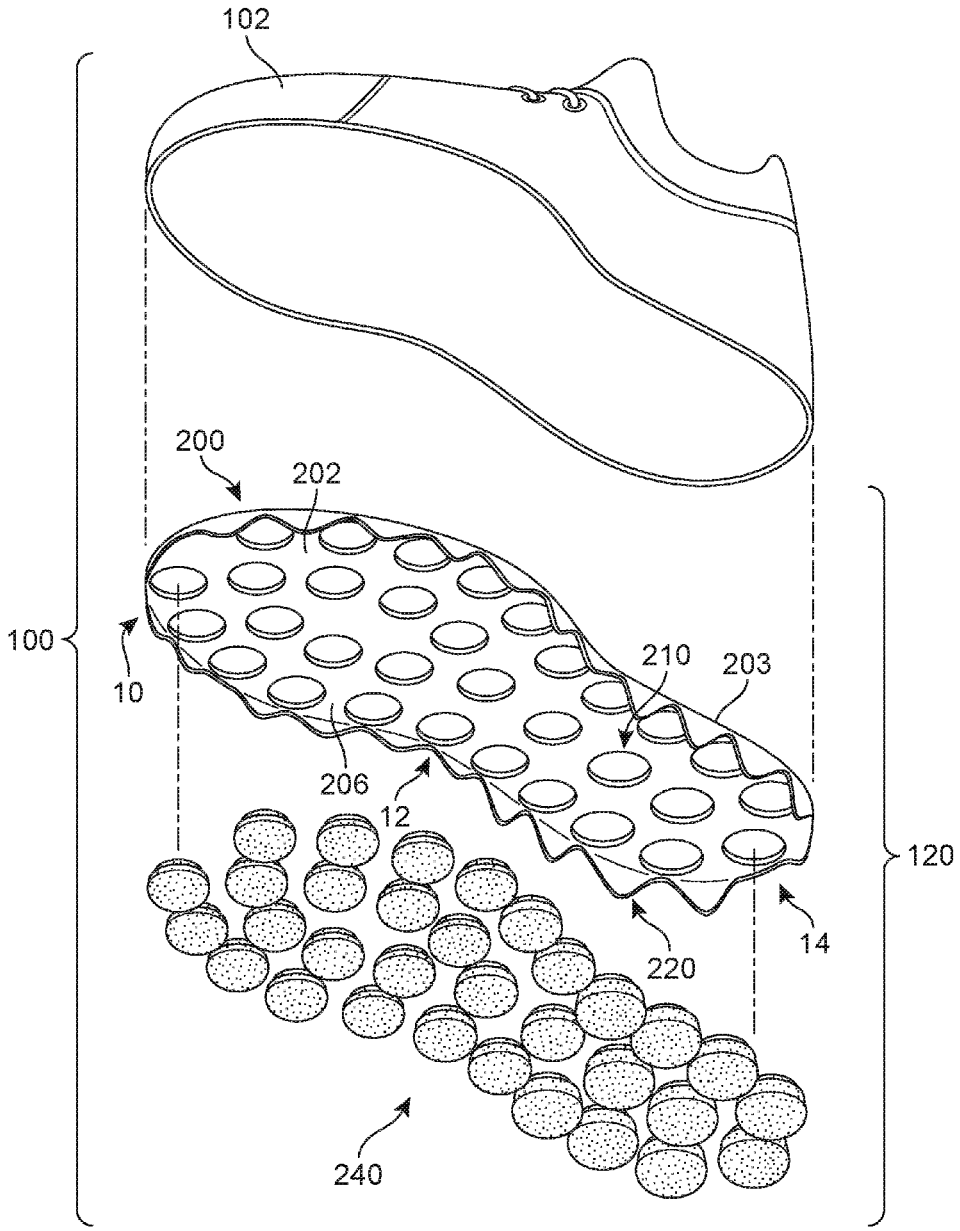
FIG. 4 is a schematic view of he components shown in FIG. 3 as viewed from below.

FIGS. 3-4 illustrate exploded isometric views of article 100, including various subcomponents of sole system 120, as well as upper 102. Referring to FIGS. 3-4, sole system 120 may be further comprised of carrier member 200 and plurality of sensory node elements 240. In some embodiments, sole system 120 may also include optional insole or strobel element (not shown).

Carrier member 200 may be configured to receive and facilitate the use of plurality of sensory node elements 240 on a bottom side of article of footwear 100. As seen in FIGS. 3-4, carrier member 200 is comprised of base portion 202. Base portion 202 is further comprised of inner surface 204 and an opposing outer surface 206. Inner surface 204 may face toward and contact portions of upper 102, while outer surface 206 faces toward a ground surface during use.

In different embodiments, the geometry of base portion 202 could vary. In the embodiment shown in FIGS. 3-4, base portion 202 has the approximate geometry of a foot sole and extends approximately in a plane associated with the longitudinal and lateral directions of sole system 120. Although approximately planar in geometry, base portion 202 may have some curvature in at least some embodiments. For example, in some embodiments, base portion 202 has a contoured inner surface 204 that approximately conforms to the geometry of a foot.

Figure 5:
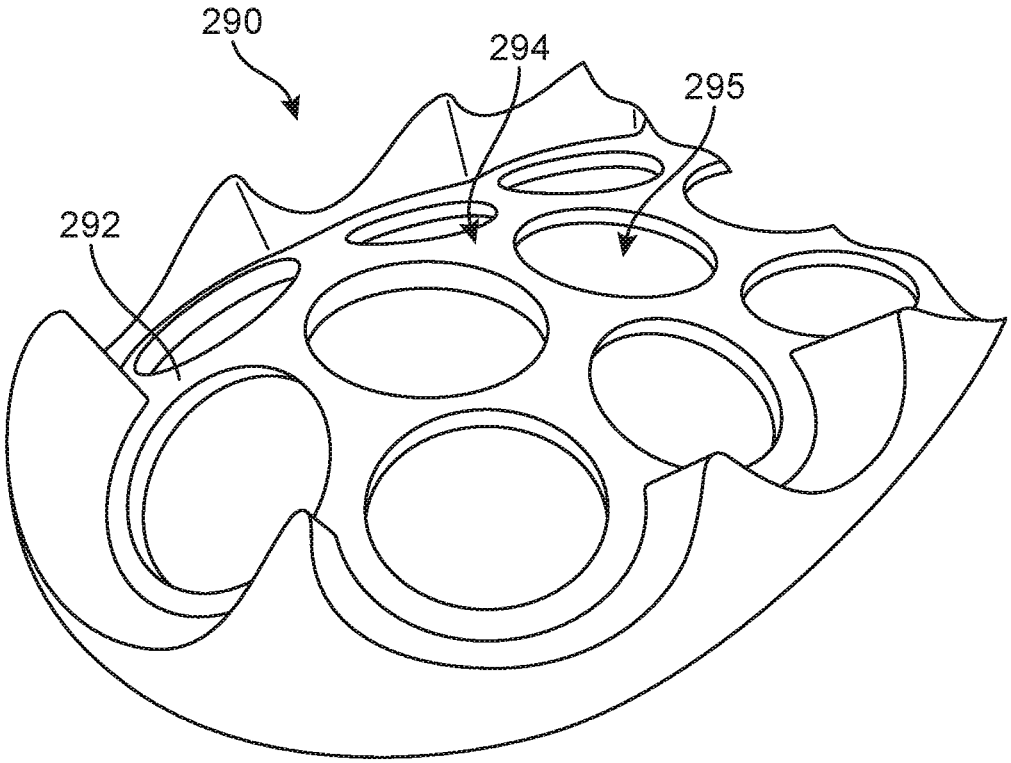
FIG. 5 is a schematic view of a heel portion of a carrier member according to an embodiment.

In other embodiments, however, base portion 202 could have an approximately flat inner surface 204. As an example, FIG. 5 illustrates an isometric view of an alternative embodiment where carrier member 290 has curved base portion 292. For purposes of illustration, only a heel portion of carrier member 290 is shown in FIG. 5. Specifically, curved base portion 292 is curved outward (convex) on outer surface 294, and also curved inward (concave) on an inner surface opposite of outer surface 294. The curvature of base portion provides recesses 295 that are oriented at various different non-parallel directions. This configuration may further position sensory node elements (not shown) into a curved inner surface so as to provide a curved receiving surface for an insole, upper layer, and/or foot. Such an alternative configuration may provide a sole system with a contoured geometry that adapts to the natural contours of a foot and facilitates increased sensory perception. It may be appreciated that in such embodiments, the forefoot and midfoot may also be contoured.

Referring back to the embodiment of FIGS. 3-4, base portion 202 may include plurality of recesses 210 that correspond with plurality of sensory node elements 240. Moreover, plurality of recesses 210 comprise through-hole recesses that extend completely from inner surface 204 to outer surface 206 of base portion 202. As discussed in further detail below, the use of through-hole recesses allows sensory node elements to be partially retained within base portion 202 and to directly engage with an upper, insole, or other inner foot-receiving layer.

Figure 18:
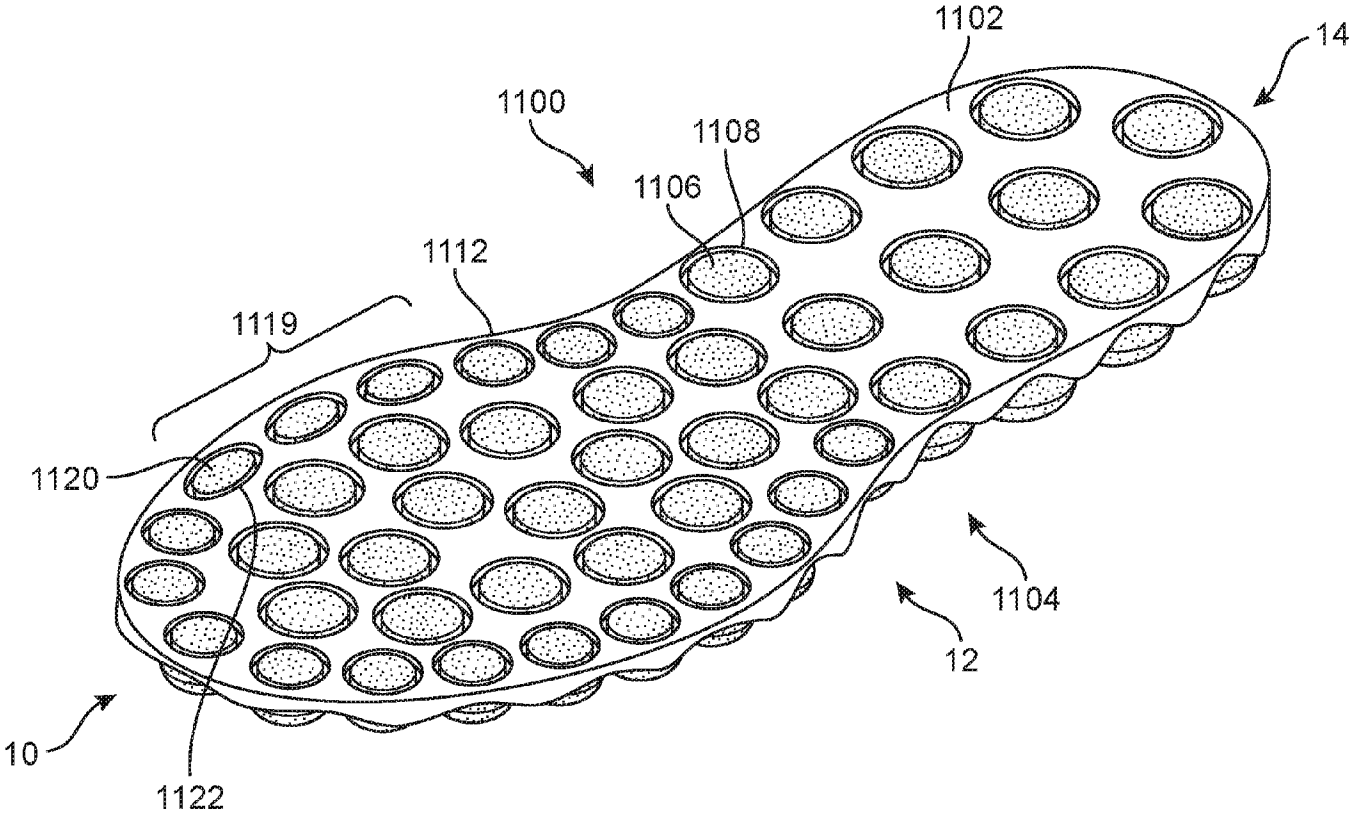
FIG. 18 is a schematic view of an embodiment of a sole system with sensory node elements of different shapes.

In the embodiment shown in FIGS. 3-4, plurality of recesses 210 are seen to have rounded (e.g., approximately circular) geometries. The rounded geometries of these recesses may correspond with the approximately rounded cross-sectional geometries of plurality of sensory node elements 240. In other embodiments, however, plurality of recesses 210 could have any other shapes including, but not limited to, triangular shapes, oval shapes, rectangular shapes, polygonal shapes, regular shapes, and/or irregular shapes. Moreover, in other embodiments, the recesses could have shapes corresponding to the cross-sectional shapes of one or more sensory node elements, including non-rounded sensory node elements. Such an embodiment is depicted in FIG. 18 and discussed in further detail below.

In some embodiments, a carrier member may also include a system of side portions that extend down from a periphery of a base portion of the carrier member. A side portion may comprise a "lip," "flange," or other extended portion or piece of the carrier member that extends away from the plane, or contoured surface, defined by the base portion. In the exemplary embodiment shown in FIGS. 3-4, carrier member 200 includes plurality of side portions 220 that extend from periphery 203 of base portion 202. Plurality of side portions 220 may extend in a direction away from upper 102. In particular, when sole system 100 is disposed with plurality of sensory node elements 240 against a ground surface, plurality of side portions 220 may extend vertically down from base portion 202 and toward the ground surface.

In different embodiments, the geometry of a side portion could vary. In some embodiments, side portions could form wall-like ridges, ledges, or lips around some or all of a periphery of a base portion. In other embodiments, side portions may comprise discrete or individual segments that extend partially or fully around the periphery. In the embodiment shown in FIGS. 3-4, each side portion has a fin-like, wave-like, or tooth-like geometry and is spaced apart from adjacent side portions. Moreover, the height of each side portion measured from base portion 202 may vary along the longitudinal direction of carrier member 200. In the embodiment of FIGS. 3-4, side portions disposed in heel region 14 and/or midfoot region 12 may generally have greater heights (i.e., extend further from base portion 202) than the side portions disposed in forefoot region 10. Such a configuration may provide differing levels of functionality between the forefoot and midfoot/heel. For example, as discussed in further detail below, the side portions may act to limit lateral motion in the plurality of nodes, and therefore, the use of larger (i.e., taller) side portions in the midfoot/heel may increase the lateral stability provided by the nodes in the midfoot/heel relative to the forefoot.

In different embodiments, the number and configuration of side portions 220 could vary. Some embodiments could include one, two, three, or more than three side portions. As seen in FIG. 4, carrier member 200 may include at least 18 side portions, with at least nine side portions extending down on each of the medial and lateral sides of carrier member 200. Of course, in other embodiments, the number and spacing of side portions along the periphery of a carrier member may vary according to factors including, but not limited to, the sizes of sensory node elements in the sole system, as well as desired degree of lateral stability in various regions of the sole system.

Figure 6:
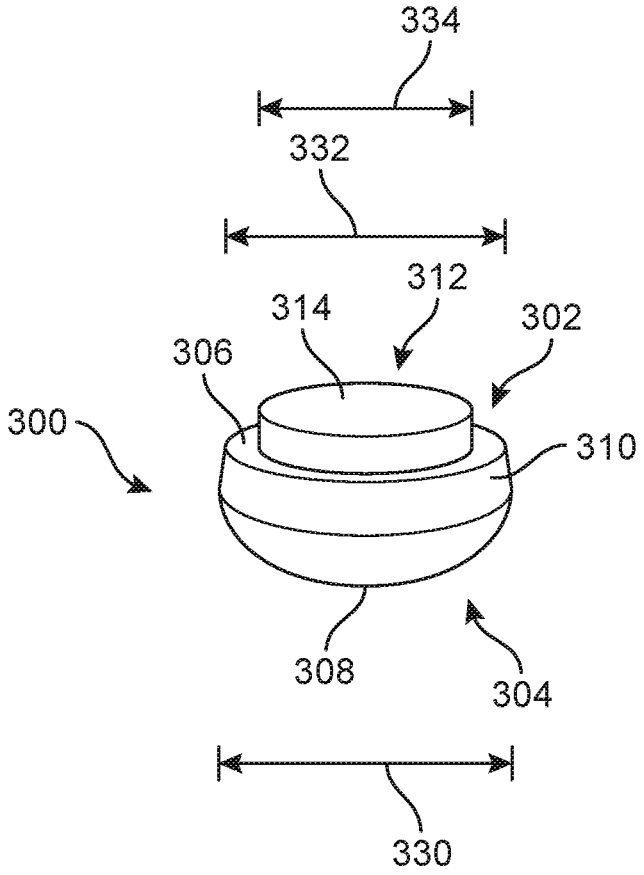
FIG. 6 is a schematic view of an embodiment of a sensory node element.

FIG. 6 illustrates a schematic view of exemplary sensory node element 300. For purposes of clarity, a single sensory node element is discussed in detail; however, it may be understood that the remaining sensory node elements of plurality of sensory node elements 240 may share some and/or all of the features of exemplary sensory node element 300, Exemplary sensory node element 300, also referred to for convenience simply as element 300, comprises top end 302 and bottom end 304. Bottom end 304 includes bottom end surface 308. Top end 302 includes peripheral top surface 306. Top end 302 also includes raised portion 312 with raised portion surface 314. Peripheral top surface 306 and bottom end surface 308 are connected by side surface 310.

In different embodiments, the geometry of a sensory node element could vary. In some embodiments, a sensory node element could have an approximately cylindrical geometry. In other embodiments, a sensory node element could have a prism-like geometry (e.g., a triangular prism or a rectangular prism). In still other embodiments, a sensory node element could have a truncated conical geometry. In the embodiment shown in FIG. 6, peripheral top surface 306 and side surface 310 have a truncated conical geometry, while bottom end surface 308 has a rounded or dome-like geometry.

In different embodiments, the height of a sensory node element could vary. In some embodiments, the height could be selected to be greater than the extension or height of one or more side portions on a carrier member. In other embodiments, however, the height could be selected to be less than the extension or height of one or more side portions on a carrier member. In absolute terms, the height of a sensory node element could vary in a range between a few millimeters and 20 centimeters. In other embodiments, a sensory node element could have a height greater than 20 centimeters. In the exemplary embodiment, it may be seen that each sensory node element of plurality of sensory node elements 240 generally are taller than the heights of plurality of side portions 220 on carrier member 200.

The diameter of a sensory node element could also vary. In some embodiments, a sensory node element could have an approximately constant diameter, corresponding with a cylindrical geometry. In other embodiments, however, a sensory node element could have a diameter that varies along its length or height. In the exemplary embodiment depicted in FIG. 6, element 300 has first diameter 330 at bottom end 304 and second diameter 332 at top end 302. It may be clearly seen that first diameter 330 is greater than second diameter 332, such that the diameter (or width) of element 300 tapers from bottom end 304 toward top end 302. Moreover, the diameter of raised portion 312 is smaller still, with diameter 334 that is less than second diameter 332. This generally tapered shape of the sensory node elements may allow for easier tilting and movement relative to a carrier member, as discussed in further detail below.

Figure 7:
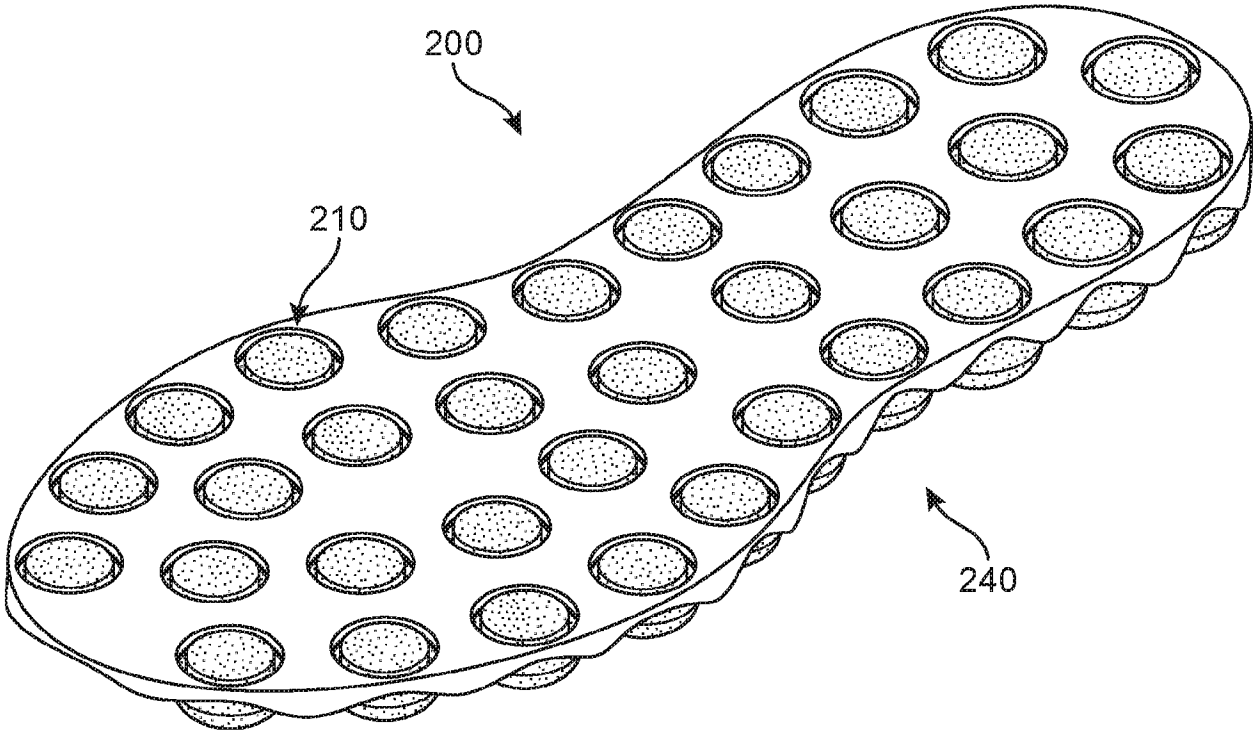
FIG. 7 is a schematic view of an embodiment of a sole system shown in isolation from other components of an article of footwear.
Figure 8:
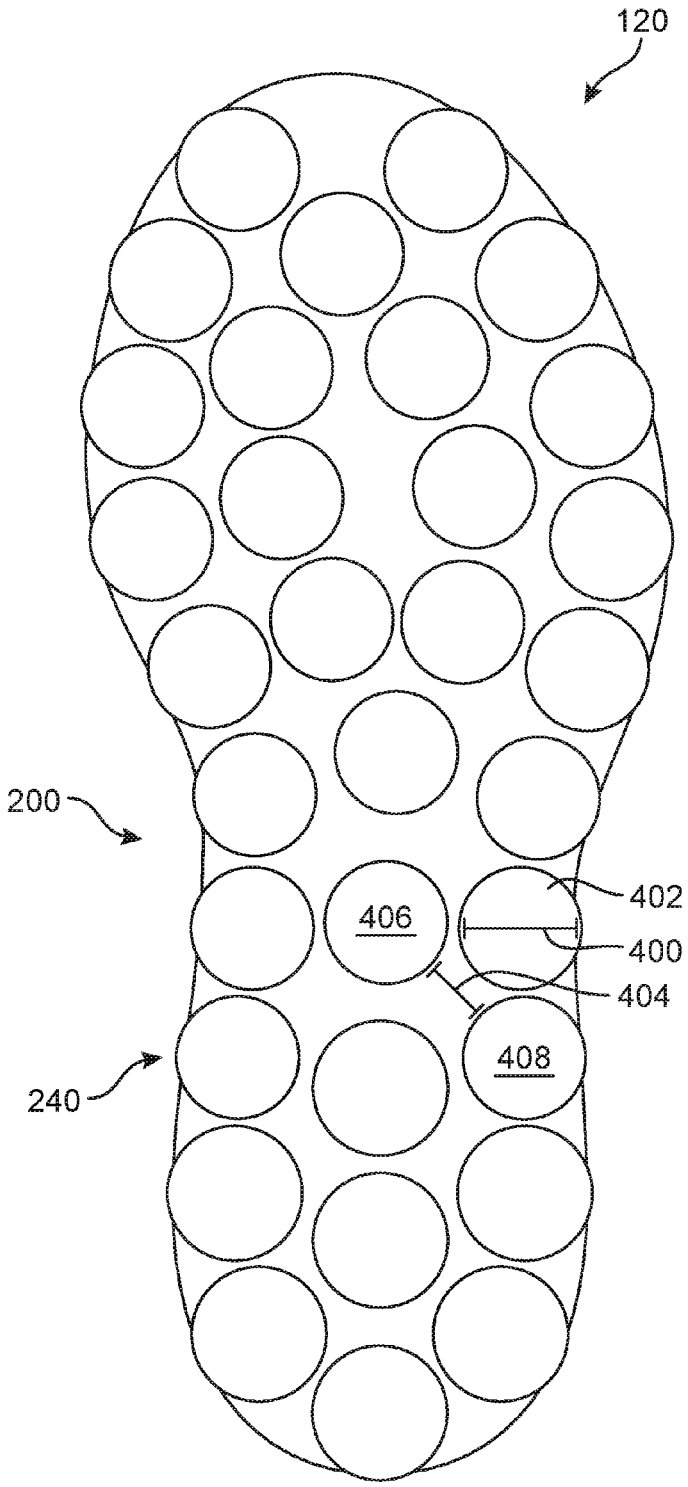
FIG. 8 is a schematic bottom view of an embodiment of a sole system.
Figure 9:
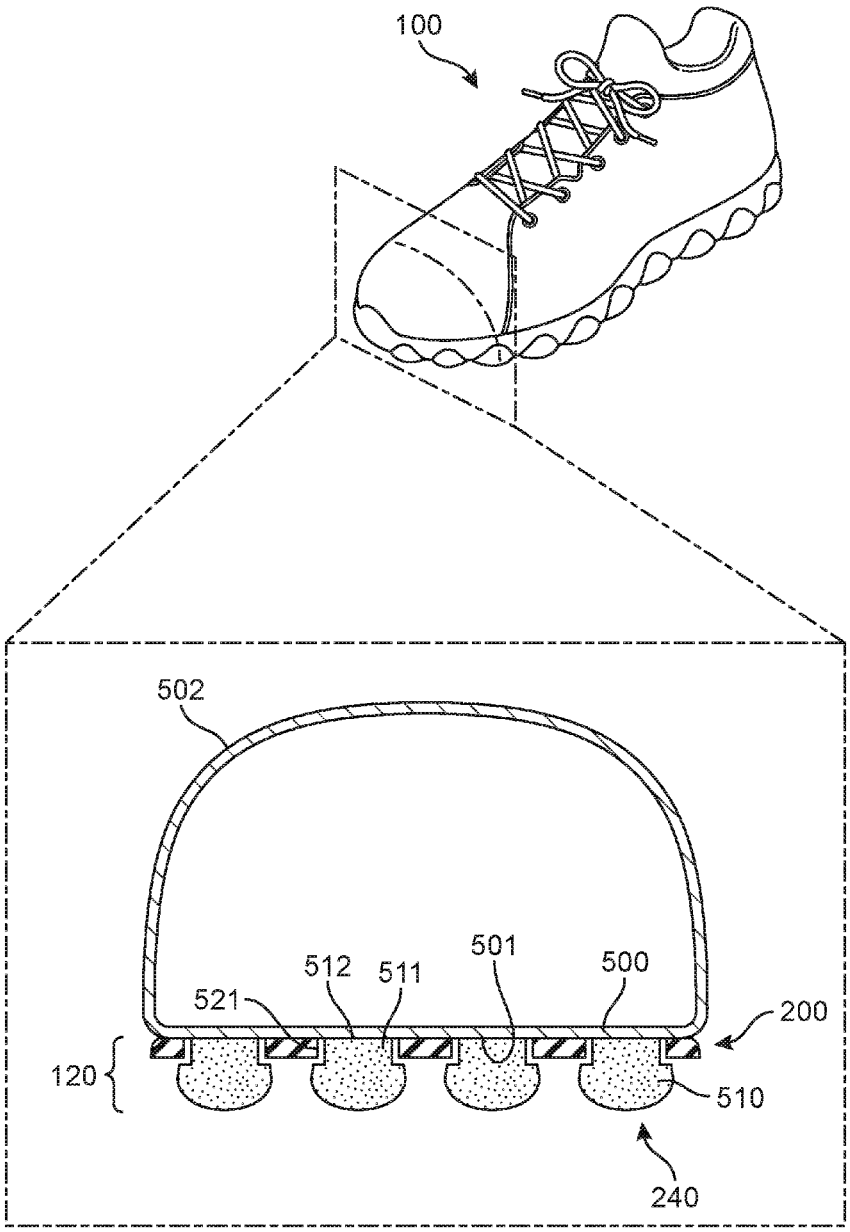
FIG. 9 is a schematic isometric view of an embodiment of an article of footwear and further includes an enlarged cross-sectional view of the article.

In different embodiments, the materials used for one or more sensory node elements could vary. Exemplary materials that could be used include, but are not limited to, various foams, polymers, or any other kinds of materials. Generally, it may be desirable to select materials that can undergo some elastic deformation to facilitate bending, cushioning, and some degree of compression due to ground-contacting forces, FIGS. 7-8 illustrate an isometric view and a bottom view, respectively, of carrier member 200 assembled with plurality of sensory node elements 240. FIG. 9 illustrates a schematic cut-away view of an embodiment of article 100, which depicts the relative configuration of carrier member 200, plurality of sensory node elements 240, and upper 502. In the exemplary embodiment shown in FIG. 9, no insole is present and instead upper 502 includes lower layer 500 that contacts sole system 120.

As shown in FIGS. 7-9, plurality of sensory node elements 240 are received into corresponding plurality of recesses 210 within carrier member 200. Specifically, the raised portions of each sensory node element fits within a corresponding recess. However, in this exemplary embodiment, none of the sensory node elements are permanently fixed to carrier member 200. Instead, as indicated in FIG. 9, plurality of sensory node elements 240 are attached to lower layer 500 of upper 502. For example, in FIG. 9, sensory node element 510 has raised surface portion 512 (of raised portion 511) that is bonded directly to outer surface 501 of lower layer 500. Although sensory node element 510 is not attached directly to carrier member 200, the increased diameter of sensory node element 510 just below raised portion 511 prevents sensory node element 510 from passing through its corresponding recess 521. Thus, this mode of attachment secures plurality of sensory node elements 240 directly to upper 502, and simultaneously helps to secure plurality of sensory node elements 240 within carrier member 200. In some cases, carrier member 200 may be separately bonded, or otherwise attached, to upper 502. In other cases, however, carrier member 200 is held against upper 502 via plurality of sensory node elements 240 only.

Although the embodiment of FIG. 9 depicts sensory node elements directly attached to a portion of an upper, in other embodiments sensory node elements could be directly attached to other components such as an insole, strobel layer, or other component within an article of footwear.

The number and arrangement of sensory node elements within a sole system can be selected according to various factors including, but not limited to, the desired level of cushioning, stability, and the requirements for increased sensory perception at one or more regions of the foot. The exemplary embodiments shown in FIGS. 1-9 depict a configuration in which the plurality of sensory node elements are distributed across the entire lower surface of a sole system. In particular, the entire ground-contacting surface of sole system 120 is comprised of the bottom ends of plurality of sensory node elements. However, in other embodiments, only some regions of a sole system could incorporate sensory node elements. For example, other embodiments could include partial length (and/or partial width) carrier members that include recesses for sensory node elements only in some specific regions of a sole system. Embodiments could incorporate any of the sensory node element patterns and configurations disclosed in U.S. patent application Ser. No. 15/061,196, published as U.S. Patent Publication No. 2017/0251753 and U.S. patent application Ser. No. 15/061,198,published as U.S. Patent Publication No. 2017/0251754 the entirety of each application being herein incorporated by reference.

Referring to FIG. 8, the illustrated embodiment packs sensory node elements close together to form a semi-continuous ground-contacting surface on the bottom of sole system 120. The density of sensory node elements can be characterized according to the spacing between adjacent sensory node elements. As used herein, sensory node elements are "adjacent" if there are no other sensory node elements along a straight line (or axis) extending between them. As seen in FIG. 8, adjacent sensory node elements may contact, or nearly contact, one another. Moreover, in embodiments where sensory node elements are spaced apart slightly, the sensory node elements may still be within a predetermined minimum distance of one another. The predetermined minimum distance may be defined by a sensory node element having a minimum, or smallest, diameter from among the plurality of sensory node elements. In FIG. 8, this predetermined minimum distance is indicated as distance 400 associated with a diameter of smallest sensory node element 402. It is then clear that any two adjacent sensory node elements in sole system 120 are separated by a gap or spacing that is no greater than distance 400. As an example, sensory node element 406 and sensory node element 408 are adjacent nodes separated by a relatively large gap compared to the gaps between other adjacent nodes. However, the length of gap 404 is still smaller than distance 400.

In order to facilitate stability and strength for sole system 120, a carrier member and a plurality of sensory node elements could differ in one or more material characteristics. For example, in some embodiments, a carrier member and one or more sensory node elements could have different elastic moduli. In another embodiment, a carrier member and one or more sensory node elements could differ in stiffness. In still other embodiments, a carrier member and one or more sensory node elements could differ in density. As an example, in the embodiment depicted in FIGS. 7-9, carrier member 200 may generally be stiffer than plurality of sensory node elements 240. Furthermore, carrier member 200 may have a greater density than plurality of sensory node elements 240. This arrangement may allow plurality of sensory node elements 240 to move and deform in response to various forces relative to carrier member 200, which provides a resilient surface for sole system 120.

Figure 10:
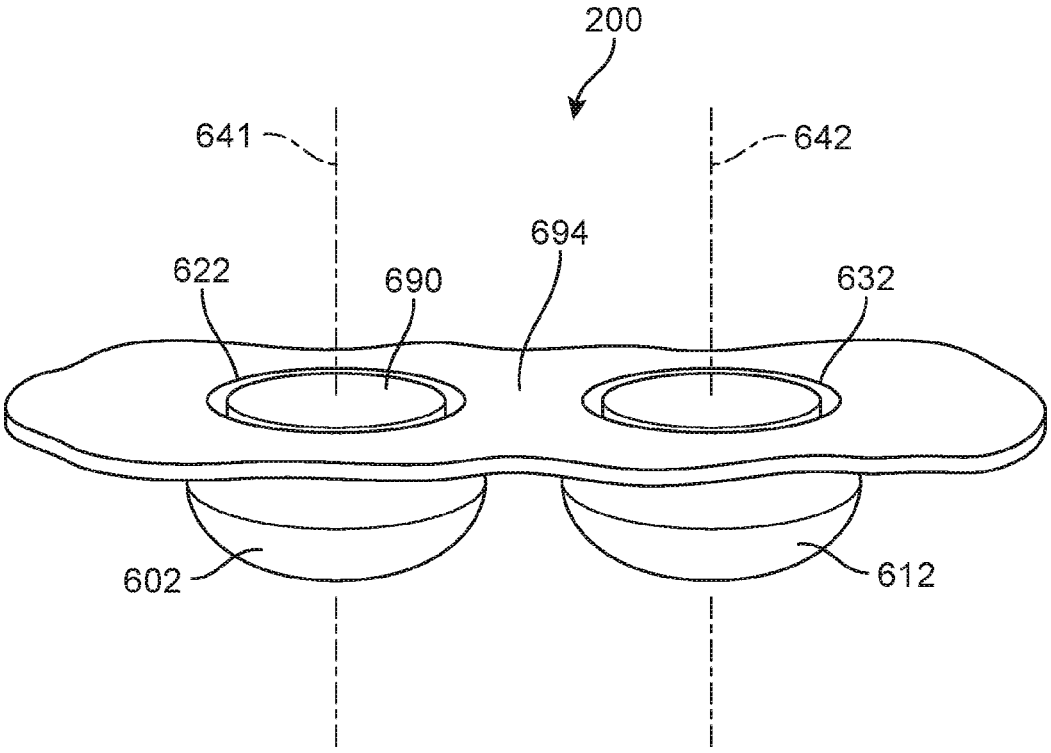
FIG. 10 is a schematic view of an embodiment of a portion of a sole system including two sensory node elements.
Figure 11:
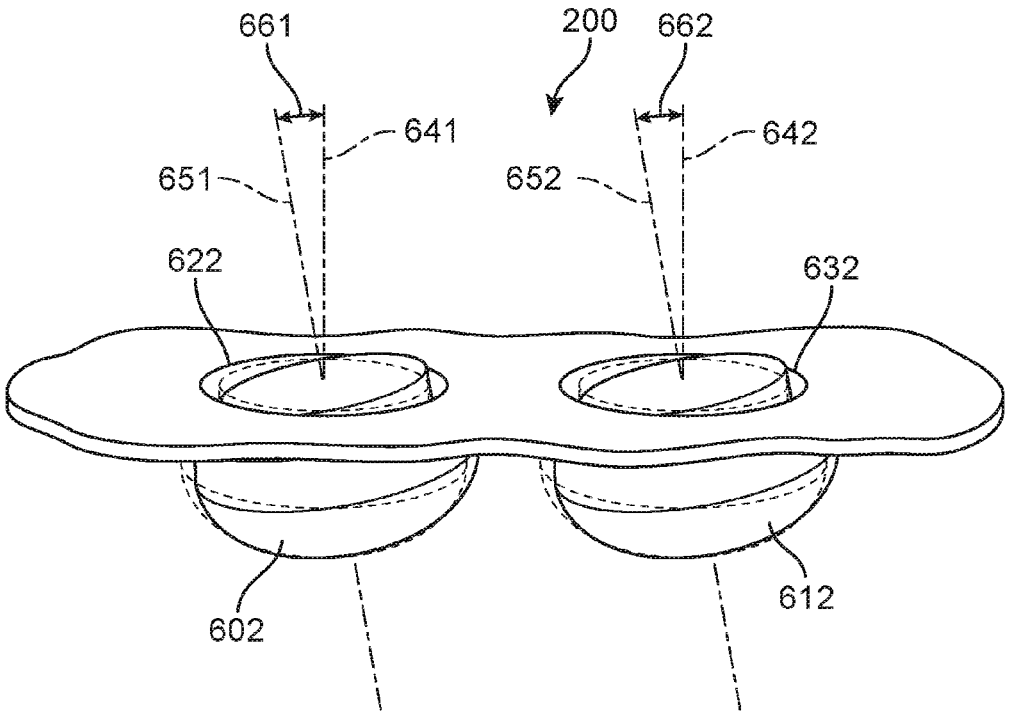
FIG. 11 is a schematic view of the portion of the sole system of FIG. 10, in which the two sensory node elements are tilted with respect to central axes of corresponding recesses.

Associating sensory node elements with recesses in a carrier member may ensure the sensory node elements remain sufficiently spaced apart to accommodate motion of the sensory node elements relative to the carrier member as well as to one another. Referring to the schematic views of FIGS. 10-11, first sensory node element 602 and second sensory node element 612 are shown positioned adjacent one another and within first recess 622 and second recess 632, respectively. First recess 622 and second recess 632 have first central axis 641 and second central axis 642, respectively. Because the sensory node elements are not fixed with respect to carrier member 200 (a portion of which is shown in FIGS. 10-11), each sensory node element can tilt, or wobble, about the central axis of a corresponding recess. For example, in a first configuration shown in FIG. 10, first sensory node element 602 and second sensory node element 612 are approximately aligned with first central axis 641 and second central axis 642 (i.e., the central axes of each sensory node element are aligned with the central axes of the corresponding recess). However, in a second configuration shown in FIG. 11, first central node axis 651 of first sensory node element 602 is seen to be tilted, or angled, with respect to first central axis 641 by angle 661. Likewise, second central node axis 652 of second sensory node element 612 is seen to be tilted, or angled, with respect to second central axis 642 by angle 662.

It may be understood that depending on the forces applied to each sensory node element, two or more sensory node elements could tilt at a similar angle (e.g., angle 661 and angle 662 may be equal) or at different angles (e.g., angle 661 and angle 662 may be different). Furthermore, while the embodiments of FIGS. 10-11 depict a single change in configuration, the sensory node elements may not only tilt but could also be capable of wobbling about a central axis. Moreover, still other modes of motion are possible and the sensory node elements could be configured to undergo any other motions consistent with their freedom to tilt, pivot, wobble, or otherwise move, with respect to the carrier member and especially the central axes of the recesses.

Thus, the sensory node elements are capable of relative motion to a carrier member, which may allow for more individual articulation and adaptiveness of the sensory node system to surfaces. This may enhance the overall ability of the sole system to increase sensory perception along regions of the foot.

In other embodiments, it may be possible to modify the spacing between adjacent recesses. Using more narrowly spaced recesses may reduce the available space (i.e., the space between adjacent nodes) within which the sensory node elements can move (e.g., wobble or tilt). Using more widely spaced recesses may increase the available space within which the sensory node elements can move. Increased motion of the nodes may allow for improved sensing as the nodes can vary their configuration to more subtle changes in contours or geometry of a ground surface. However, in some cases, increasing the ability of the nodes to move can also change cushioning and stability of the sole system. Thus, the relative spacing between adjacent recesses can be varied in order to tune the dynamic properties of the sensory node system in a manner that optimizes increased sensory perception and desired levels of cushioning and/or stability. Still further, the spacing can be approximately uniform or can vary by region, thereby provide even more control over the dynamics of the nodes and their ability to improve sensory perception in various regions of the foot.

Figure 12:
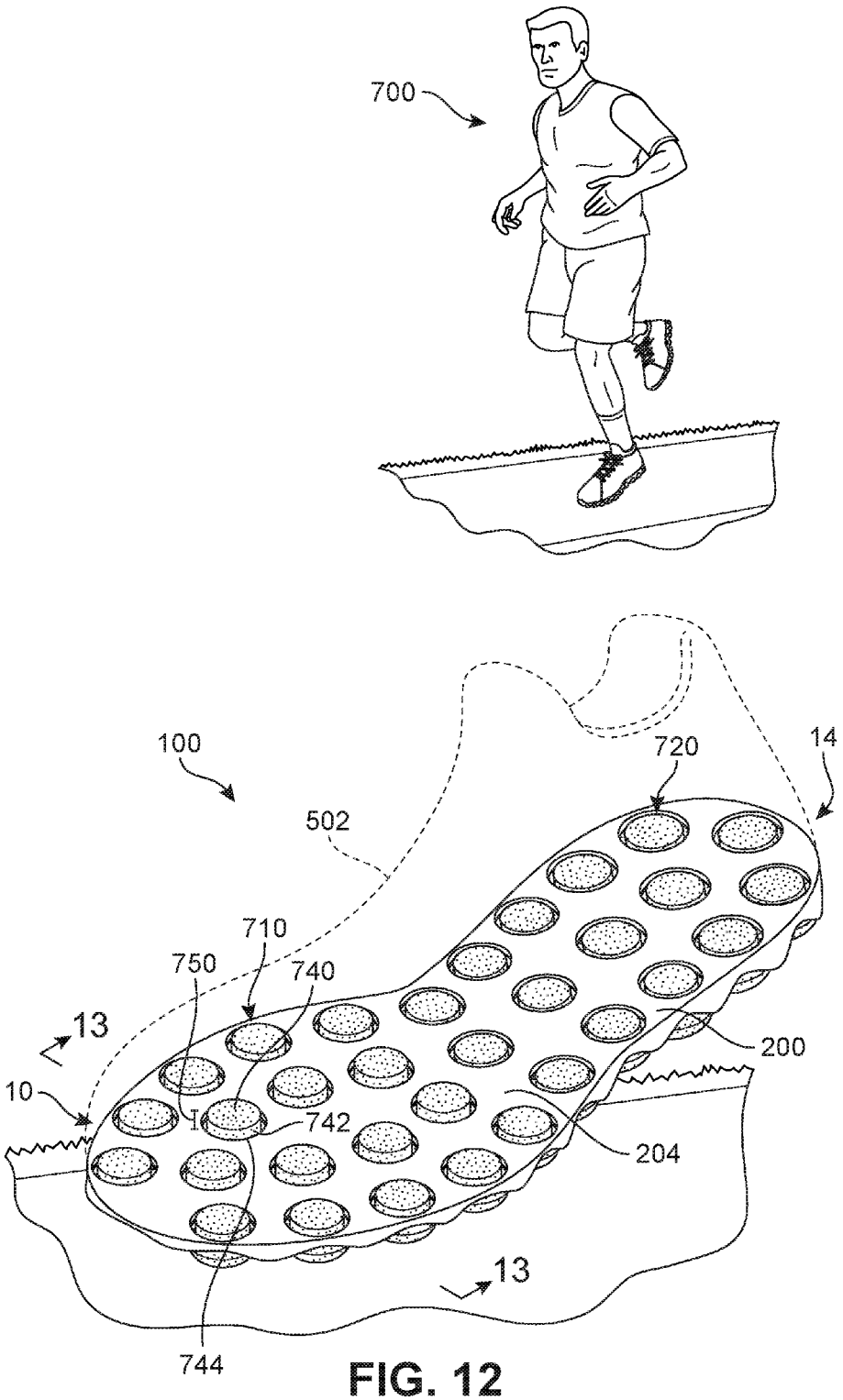
FIG. 12 is a schematic view of an embodiment of a set of sensory node elements pushing into an interior of an article of footwear during contact with a ground surface.

FIG. 12 illustrates a schematic isometric view of article of footwear 100 during use by athlete 700. For purposes of illustration, upper 502 is shown in phantom in FIG. 12. Referring to FIG. 12, during contact with a ground surface, the sensory node elements in contact with the ground may be displaced and protrude slightly into the interior cavity of upper 502. For example, in the embodiment of FIG. 12, set of sensory node elements 710 in forefoot region 10 pushes up into the interior cavity, while other sensory node elements (e.g. set of sensory node elements 720 in heel region 14) remain in a generally flush configuration with carrier member 200. This displacement of only some sensory node elements creates extra sensory perception in localized regions (i.e., in the forefoot of the foot in FIG. 12).

The displacement of a sensory node element can be characterized by a distance between a reference surface of the sensory node element and an inner surface of a carrier member at a location adjacent the sensory node element (and also the recess within which the sensory node element is set). Specifically, a top surface of a sensory node element may be approximately flush with the inner surface of a carrier member, or may be some preset distance from the inner surface. Such a configuration is depicted in, for example, FIG. 10, where innermost surface 690 of sensory node element 602 is approximately flush with portion 694 of carrier member 200 directly adjacent to sensory node element 602. When forces (for example, forces applied by the ground against the sensory node element) act to displace the sensory node element, the innermost surface may be raised up into the upper and may therefore be disposed further from the inner surface of the carrier member. For example, in FIG. 12, top surface 740 of sensory node element 742 is displaced distance 750 from adjacent portion 744 of inner surface 204. This configuration of raised node elements as shown in FIG. 12 may act to create a push-off surface from which a user's foot can grip and push off within article 100.

Figure 13:
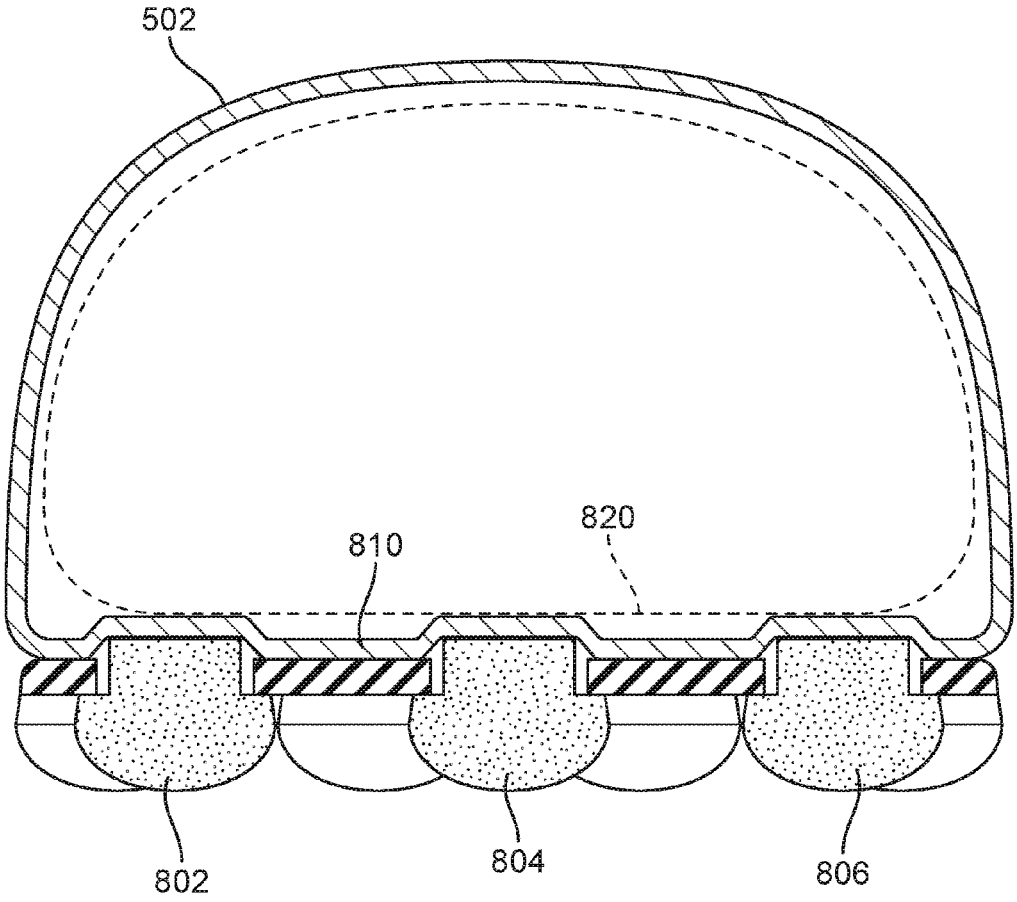
FIG. 13 is a schematic cross-sectional view of an article of footwear according to an embodiment.

In embodiments using an insole or other inner foot-receiving layer, sensory node elements may depress against the insole or inner foot-receiving layer to push it further into an interior cavity of the upper. For example, FIG. 13 shows a cross-sectional view of article 100 (see FIG. 12) while several sensory node elements are displaced from their neutral configuration. Referring to FIG. 13, sensory node element 802, sensory node element 804, and sensory node element 806 are all pushed inwardly (i.e., away from the ground) and further act to push up against inner foot receiving layer 810 (e.g., a bottom side of upper 502). This changes the geometry of the inner surface of inner foot receiving layer 810 from a generally planar or flat surface to a curved surface with many local features (corresponding with the ends of the sensory node elements). For example, as shown in FIG. 13, inner foot receiving layer 810 has been deformed to a contoured surface geometry that may provide increased sensory perception at a local region of foot 820.

Embodiments can include provisions to limit lateral movement, or tilting, of some sensory node elements. In some embodiments, provisions for limiting the motion of sensory node elements along the lateral and/or medial edges of a sole may be used. Such provisions can help promote stability along the lateral and/or medial edges of the sole.

Figure 14:
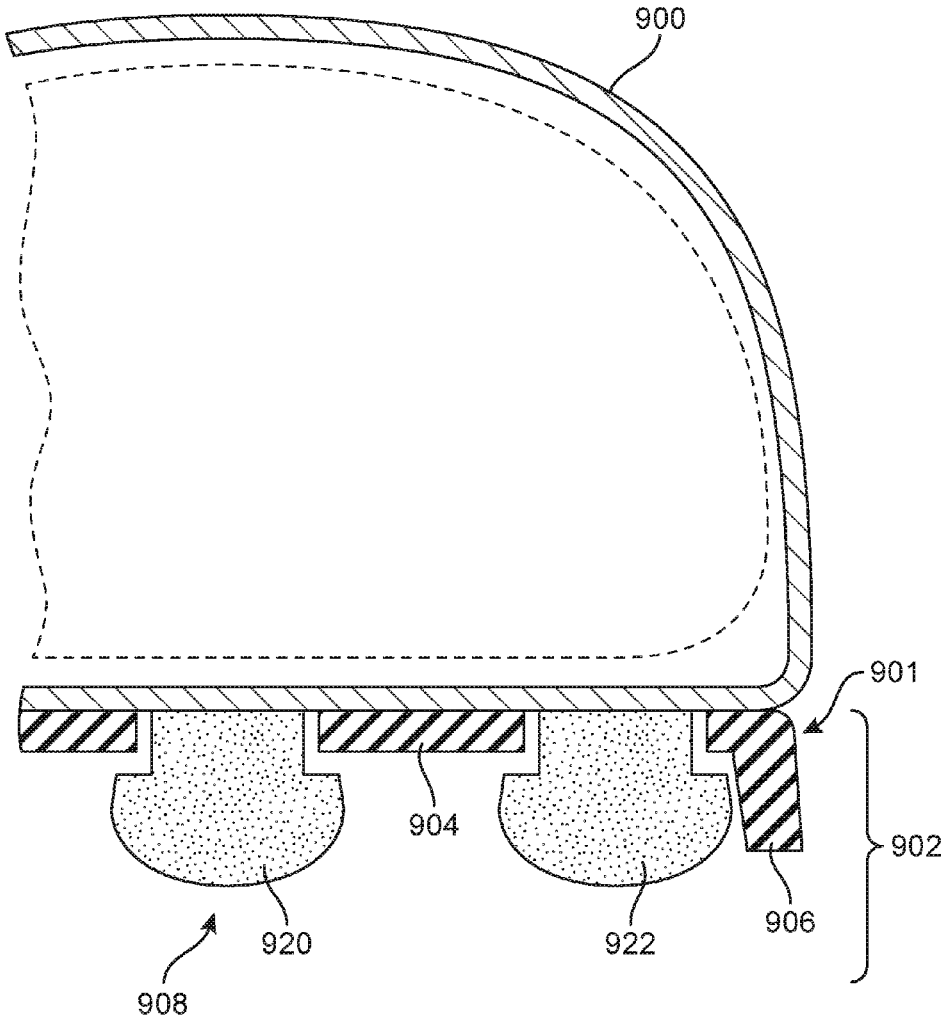
FIG. 14 is a schematic cross-sectional view of an article of footwear with sensory node elements according to an embodiment.
Figure 15:
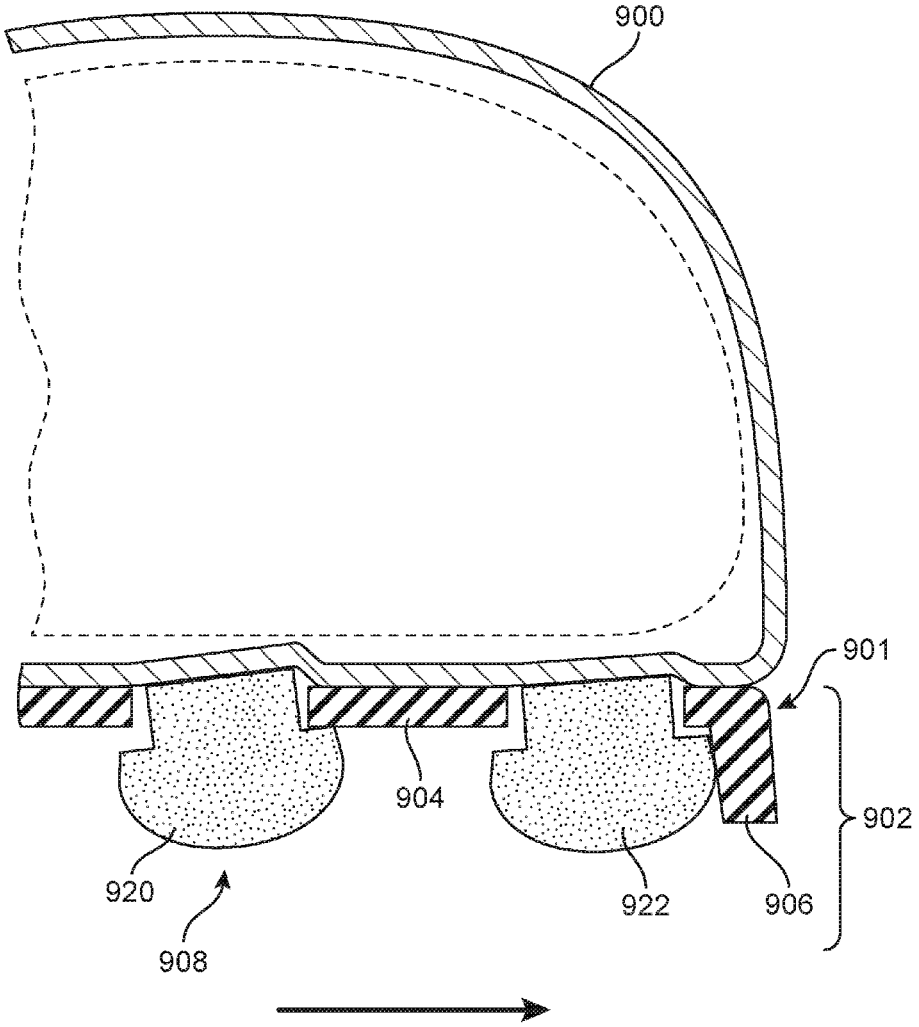
FIG. 15 is a schematic cross-sectional view of the article of FIG. 14, in which the sensory node elements undergo some tilting.

FIGS, 14 and 15 illustrate schematic side cross-sectional views of a portion of an article with upper 900 and sole system 902 in a neutral state (FIG. 14) and a loaded state (FIG. 15), respectively. Sole system 902 further includes carrier member 901 with base portion 904 and at least one side portion 906. Sole system 902 also includes plurality of sensory node elements 908. As seen in moving from FIGS. 14 to 15, as forces cause plurality of sensory node elements 908 to tilt, side portion 906 of carrier member 901 may limit the extent to which an adjacent sensory node element can move. Specifically, first sensory node element 920 located inward of the edge is seen to tilt more than second sensory node element 922 located directly adjacent side portion 906. This may occur as second sensory node element 922 contacts side portion 906. Because side portion 906 is stiff and does not yield to second sensory node element 922, it thereby prevents any further lateral movement of second sensory node element 922.

Absent a side portion, some embodiments could include other provisions to maintain or increase lateral stability in a sole system. In some embodiments, some sensory node elements could be fixed in place relative to a carrier member at locations along a lateral and/or medial edge of the carrier member.

Figure 16:
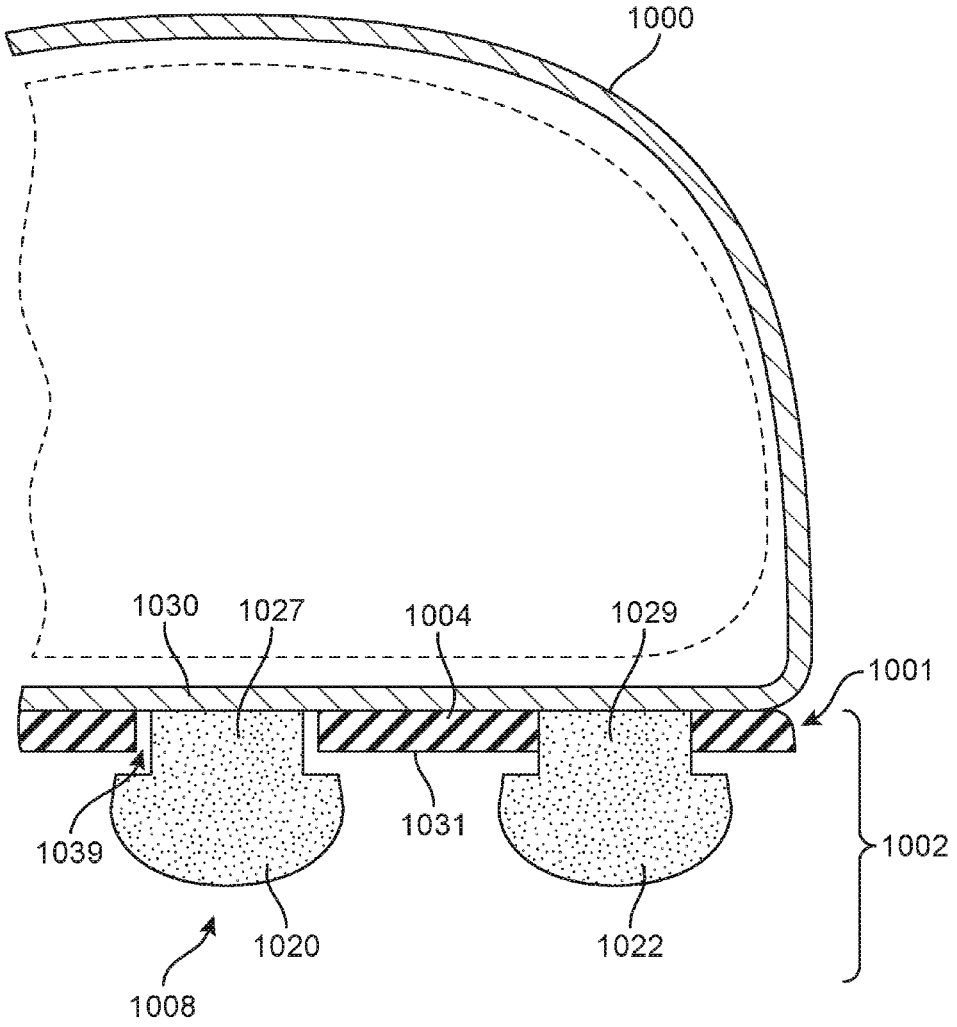
FIG. 16 is a schematic cross-sectional view of an article of footwear with sensory node elements according to an embodiment.
Figure 17:
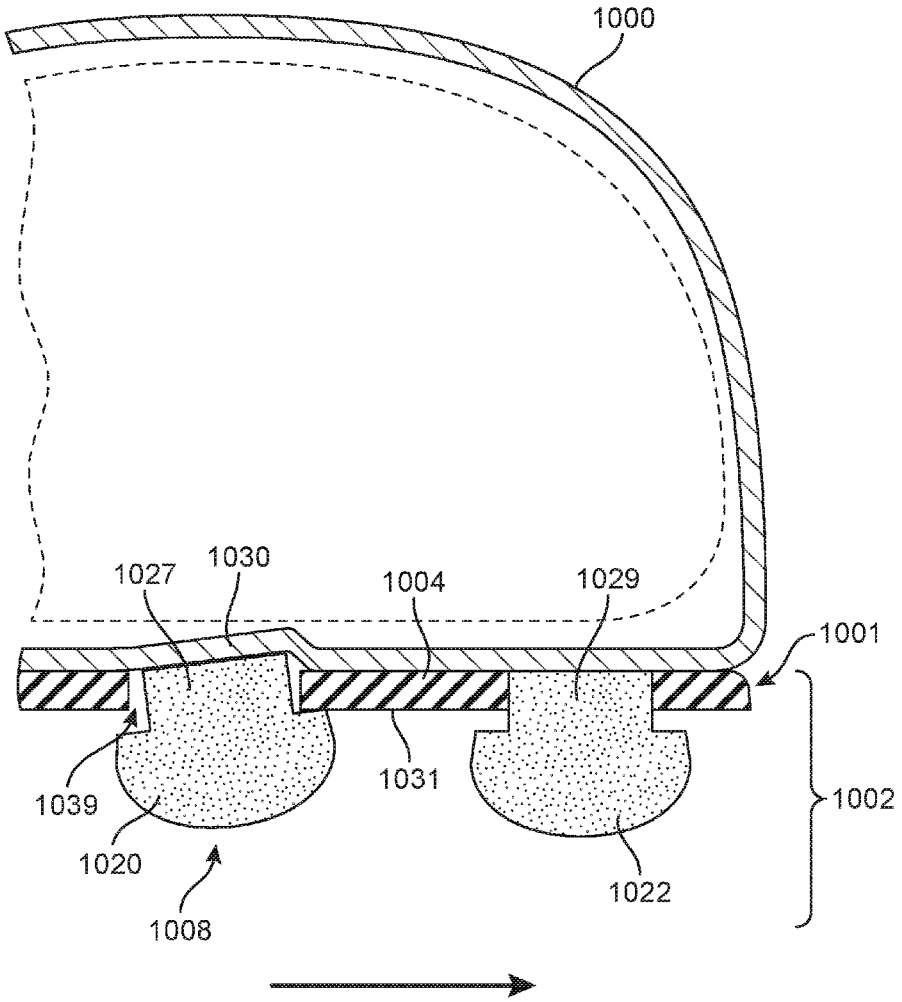
FIG. 17 is a schematic cross-sectional view of the article of FIG. 16, in which one sensory node element tilts and another sensory node element does not tilt.

FIGS. 16 and 17 illustrate schematic side cross-sectional views of a portion of an article with upper 1000 and sole system 1002 in a neutral state (FIG. 16) and a loaded state (FIG. 17), respectively. Sole system 1002 further includes carrier member 1001 with base portion 1004 and plurality of sensory node elements 1008. As seen in FIGS. 16 and 17, first sensory node element 1020 is attached to inner foot receiving layer 1030 but otherwise able to move and tilt relative to carrier member 1001. In contrast, second sensory node element 1022 is fixed to inner foot receiving layer 1030 but unable to move substantially relative to carrier member 1001. In this case, the opening receiving second sensory node element 1022 is sized and shaped to fit a top end 1029 of second sensory node element 1022 without any room for sensory node element 1022 to wobble or tilt relative to carrier member 1001. This may be considered as contrasting with the configuration for first sensory node element 1020 where top end 1027 is smaller than opening 1039, which allows first sensory node element 1020 to move and tilt within carrier member 1001. In other embodiments, an adhesive could be used to help bond a node element to a carrier member in order to fix it in place and limit motion or wobble relative to a carrier member.

The arrangement shown in FIGS. 16-17 results in second sensory node element 1022 staying fixed even under loading, which allows for improved lateral stability along an edge of sole system 1002. Of course while the embodiments depict a single sensory node element fixed to a carrier member, other embodiments could include many sensory node elements fixed along the lateral and/or medial edges of a carrier member to improve lateral stability by limiting lateral movement or tilting of sensory node elements at those edges.

FIG. 18 illustrates another embodiment of sole system 1100. Sole system 1100 may be similar in one or more respects to sole system 120 depicted in earlier figures and described above. Sole system 1100 includes plurality of sensory node elements 1104 disposed in forefoot region 10, midfoot region 12, and heel region 14 of carrier member 1102.

Referring to FIG. 18, some embodiments can include sensory node elements having different sizes and/or shapes. For example, sole system 1100 includes set of sensory node elements 1119 along side edge 1112 in forefoot region 10 of carrier member 1102. Set of sensory node elements 1119 may have approximately elliptical or oval shapes. For example, exemplary sensory node element 1120 has an oval shape and matches a corresponding oval shaped recess 1122 of carrier member 1102. In contrast, many other sensory node elements are circular in shape. For example, exemplary sensory node element 1106 in heel region 14 has a circular shape and matches a corresponding circular shaped recess 1108 in carrier member 1102. By using different shapes for the sensory node elements, it may be possible to accommodate nodes in a variety of different locations, including on contoured regions of a carrier member, such as a contoured or raised, side edge. Using modified shapes also allows for sensory node elements to be more closely packed together in different patterns to maximize the coverage of sensory node elements along the sole of the foot.

Embodiments can include provisions for varying the degree to which one or more sensory node elements protrude into an interior cavity. In some embodiments, different sensory node elements can include raised portions of different heights (i.e., the distance between the base of the sensory node element and the top surface of the raised portion). In some embodiments, different sensory node elements in different regions of a sole system can be configured with different heights.

Figure 19:
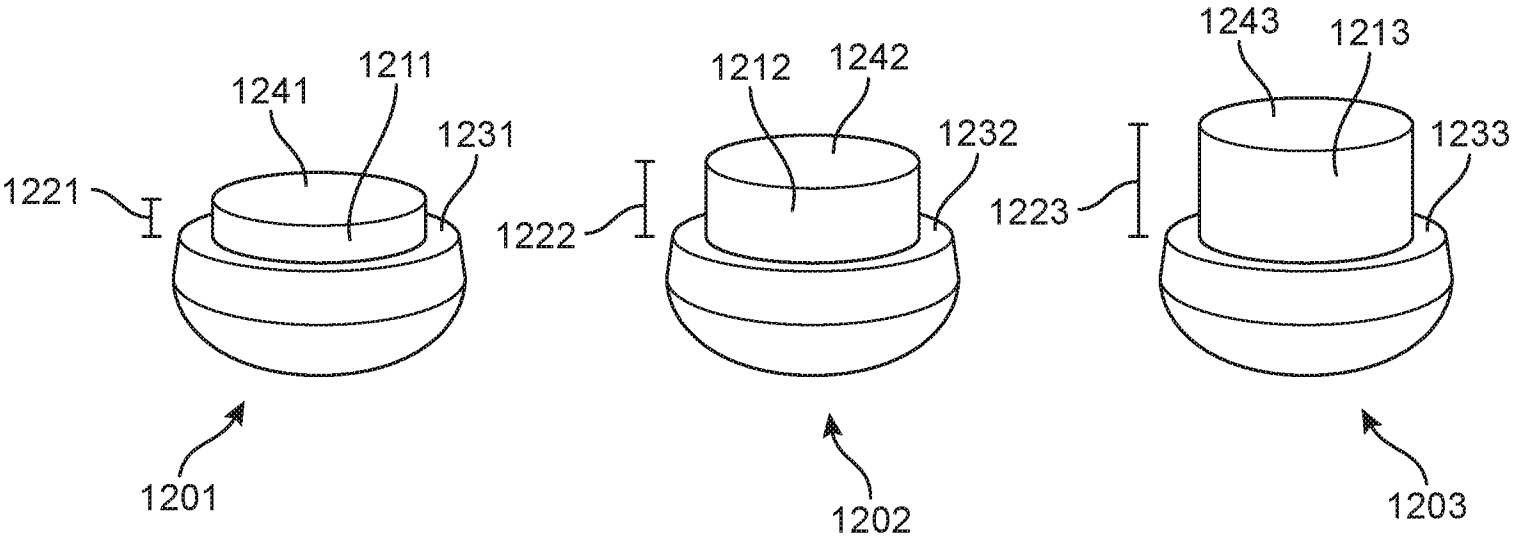
FIG. 19 is a schematic view of an embodiment of a sole system with sensory node elements of different heights.

As an example, FIG. 19 illustrates three exemplary sensory node elements having raised portions with different heights. Referring to FIG. 19, sensory node element 1201 has raised portion 1211 with height 1221 (measured between top peripheral surface 1231 and raised portion surface 1241). Likewise, sensory node element 1202 has raised portion 1212 with height 1222 (measured between top peripheral surface 1232 and raised portion surface 1242). In addition, sensory node element 1203 has raised portion 1213 with height 1223 (measured between top peripheral surface 1233 and raised portion surface 1243). As seen in FIG. 19, height 1223 is greater than height 1222 and height 1222 is greater than height 1221. This variation in the height of each raised portion may provide for different amounts of travel within a corresponding recess of a carrier member. In other words, sensory node elements with taller raised portions may be able to travel further into an interior cavity of an article when the sensory node elements are loaded.

Figure 20:
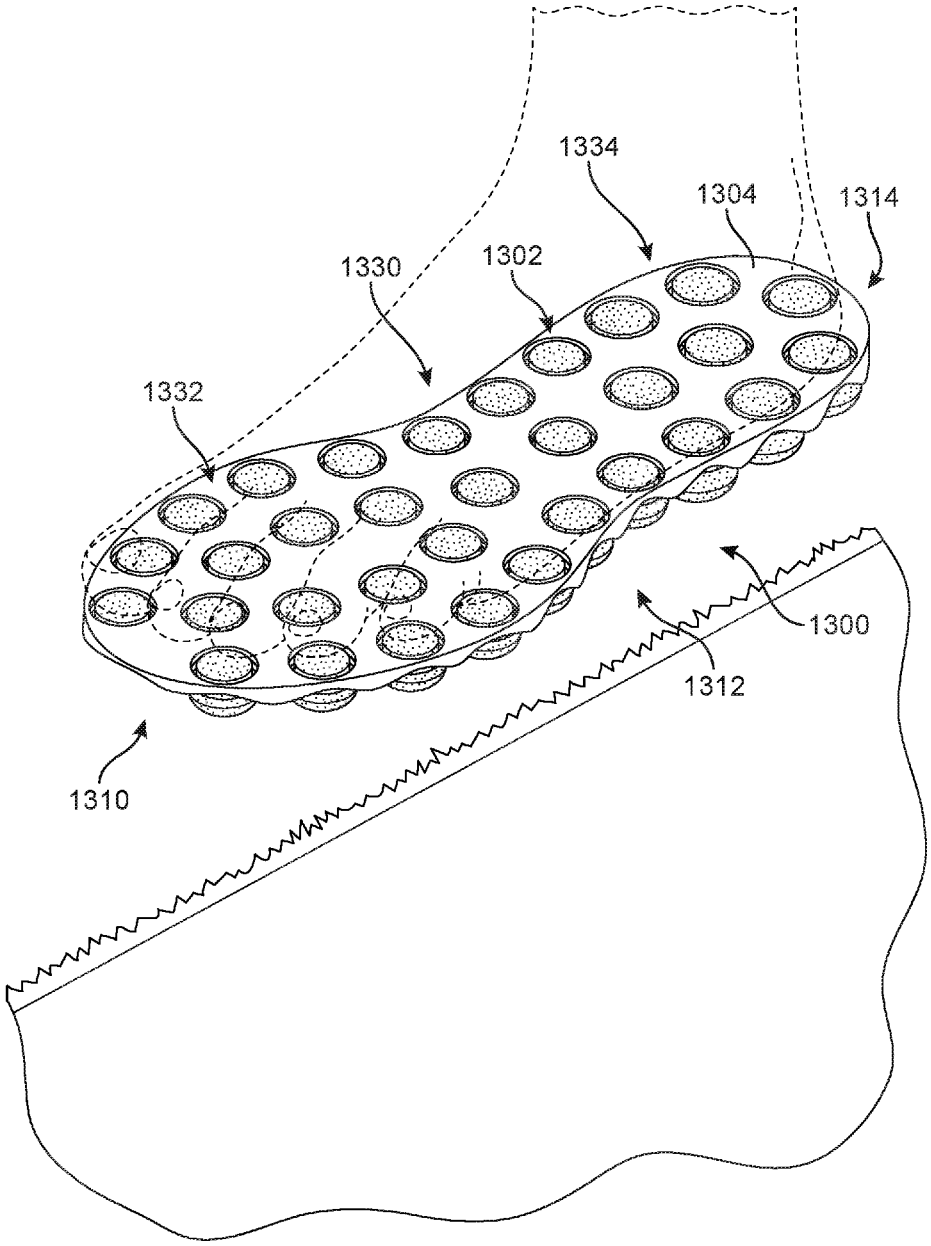
FIG. 20 is a schematic view of an embodiment of a sole system with sensory node elements of different heights in a neutral state.
Figure 21:
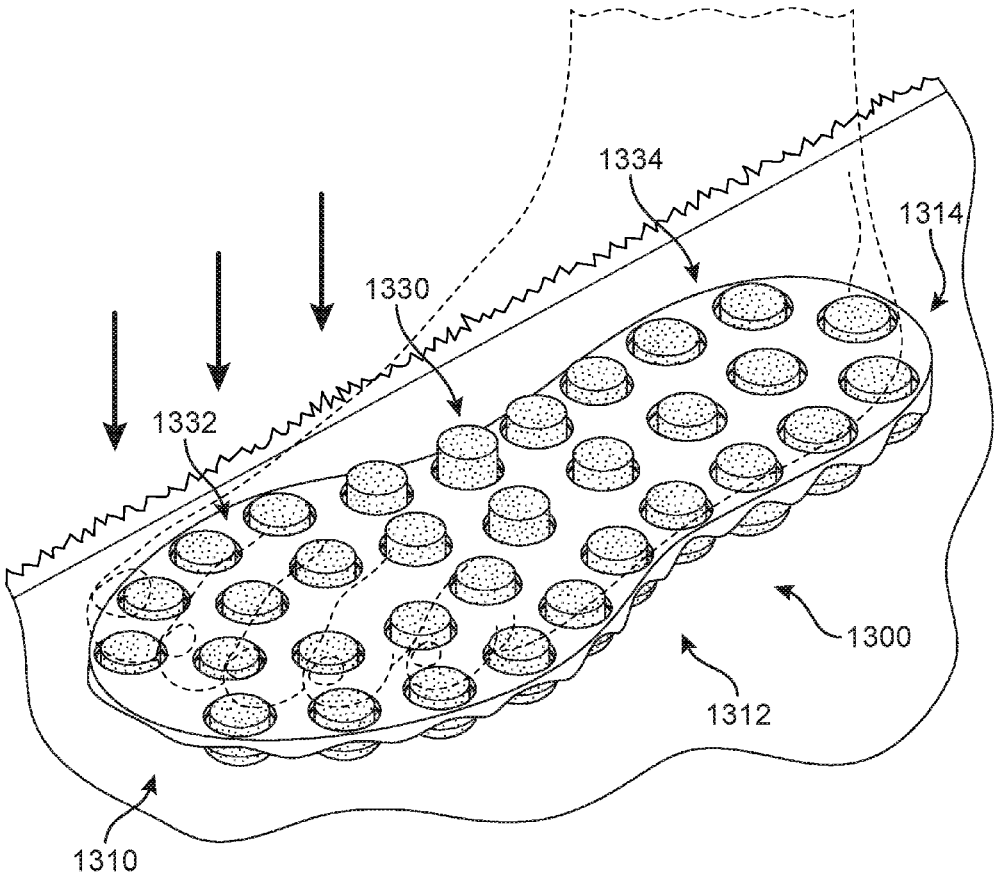
FIG. 21 is a schematic view of an embodiment of the sole system of FIG. 20 with sensory node elements of different heights in a loaded state.

FIGS. 20 and 21 illustrate schematic views of an embodiment of sole system 1300 in neutral (FIG. 20) and loaded (FIG. 21) states. Referring first to FIG. 20, sole system 1300 comprises plurality of sensory node elements 1302 housed within carrier member 1304. Moreover, the recessed portions of plurality of sensory node elements 1302 can be configured with varying heights according to their location within sole system 1300. For example, sensory node elements in forefoot region 1310 and heel region 1314 may have shorter heights than sensory node elements in midfoot region 1312. This allows for sensory node elements in midfoot region 1312 to be raised up higher and engage the arch of a foot that is positioned higher on the foot than the forefoot and heel. This may be clearly seen in FIG. 21, which shows set of sensory node elements 1330 in midfoot region 1312 with taller raised portions than corresponding raised portions of either set of sensory node elements 1332 in forefoot region 1310 and set of sensory node elements 1334 in heel region 1314. In still other embodiments, of course, any other configuration using sensory node elements with varying height recessed portions can be used to increase sensation in one or more regions, and/or to ensure the sensory node elements come into contact with a corresponding portion of a foot during loading (e.g., the arch of the foot).

Embodiments can include provisions for reducing the chances that dust, dirt, water, or other materials may pass through recesses in a carrier member. In some embodiments, the shapes of the recesses and/or the shapes of the sensory node elements could be modified to reduce the likelihood of materials passing through the recesses.

In addition to varying the geometry of a sensory node element and/or recess in a carrier member, embodiments can include other provisions to reduce the chances of water entering an interior of an article. In at least some embodiments, an inner layer to which the sensory node elements and carrier member are attached could be a waterproof layer or liner. In other words, an inner foot receiving layer (e.g., an insole or a lower layer on an upper) could be made of a waterproof material or include a waterproof coating. Exemplary materials that may be used can include, but are not limited to, rubber, polyvinyl chloride, polyurethane, silicone elastomer, fluoropolymers, and wax.

Figure 22:
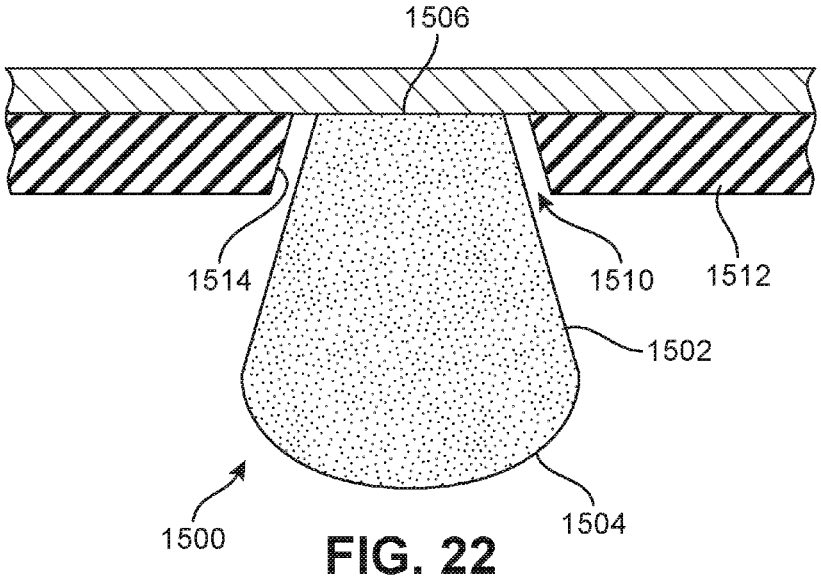
FIG. 22 is a schematic view of another embodiment of a sensory node element in a neutral state.
Figure 23:
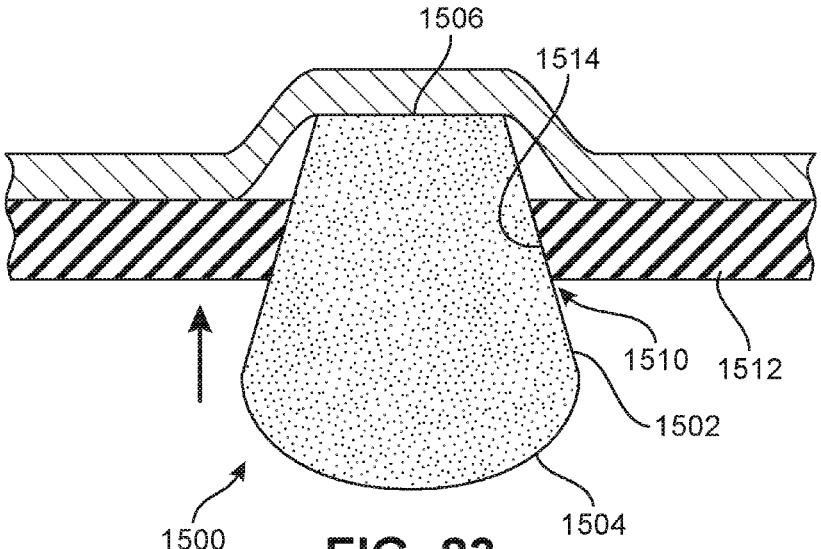
FIG. 23 is a schematic view of the sensory node element of FIG. 22 in a neutral state.

Embodiments can include other provisions for limiting the travel of a sensory node element into the interior of an article. As previously discussed, some embodiments may utilize recessed portions that fit into a recess while preventing a wider base of the sensory node element from passing through the recess and thus limiting travel into the interior of the article. Other embodiments, however, may not use a raised portion of a different diameter. In some other embodiments, a sensory node element could have a continuously variable geometry (e.g., a truncated conical geometry) that fits with a recess having sloped sidewalls. Such an embodiment is depicted in FIGS. 22 and 23. Referring first to FIG. 22, sensory node element 1500 has a smoothly varying sidewall 1502 that has constant slope between bottom end 1504 and top end 1506 (including its topmost surface). Recess 1510 in carrier member 1512 has a corresponding slanted sidewall 1514. As the sensory node element passes up into the interior of the article, the amount of travel of top end 1506 is limited according to the diameter of recess 1510. Specifically, at a certain vertical position, slanted sidewall 1514 engages sidewall 1502 of sensory node element 1500 and prevents any further travel, as depicted in FIG. 23.

Figure 24:
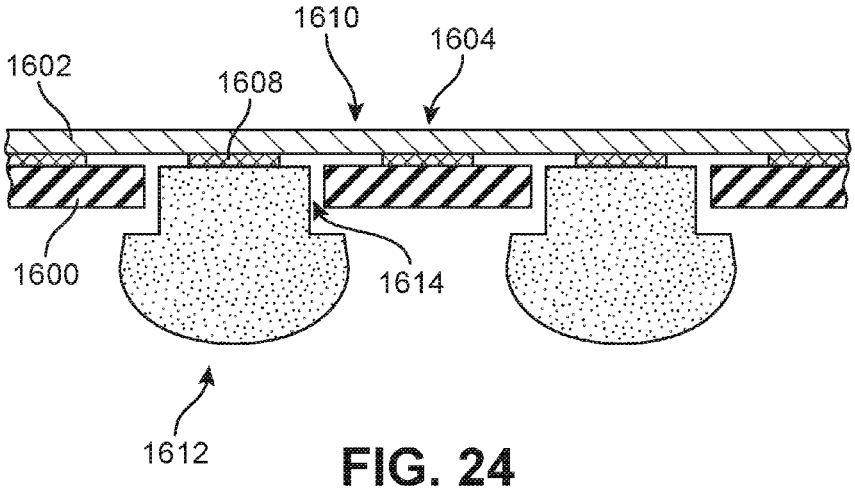
FIG. 24 is a schematic view of a gluing configuration for components of a sole system, according to an embodiment, with sensory node elements in a neutral state.
Figure 25:
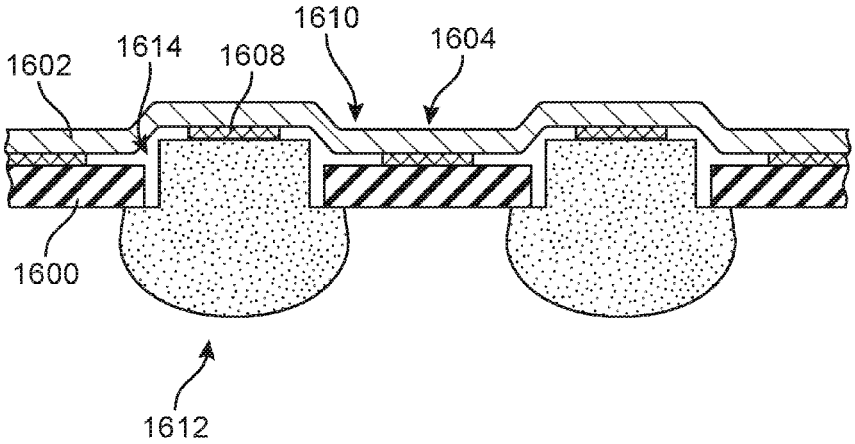
FIG. 25 is a schematic view of the components of the sole system of FIG. 24, with sensory node elements in a loaded state.

Embodiments can include various provisions to allow sensory node elements to move vertically with respect to a carrier member. In some embodiments, a carrier member may be bonded to an inner foot-receiving layer at locations proximate, but not all the way up to, the edge of each recess. Leaving the region of the layer directly adjacent the recess unattached or bonded to the carrier member may allow the layer to flex and move so that the sensory node element can push into the recess. Such an embodiment is depicted in FIGS. 24 and 25. Specifically, as shown in FIGS. 24 and 25, carrier member 1600 is bonded to inner foot receiving layer 1602 at various attachment regions 1604 (in this case using adhesive 1608). However, the inner foot receiving layer 1602 is unattached from carrier member 1600 at selected unattached regions 1610 that are immediately adjacent sensory node elements 1612 and recesses 1614. In other words, the attached regions are separated in a horizontal direction from recesses 1614. This allows inner foot receiving layer 1602 to flex or otherwise move away from carrier member 1600 as sensory node elements 1612 are pushed into an interior of an article, as shown schematically in FIG. 25.

Figure 26:
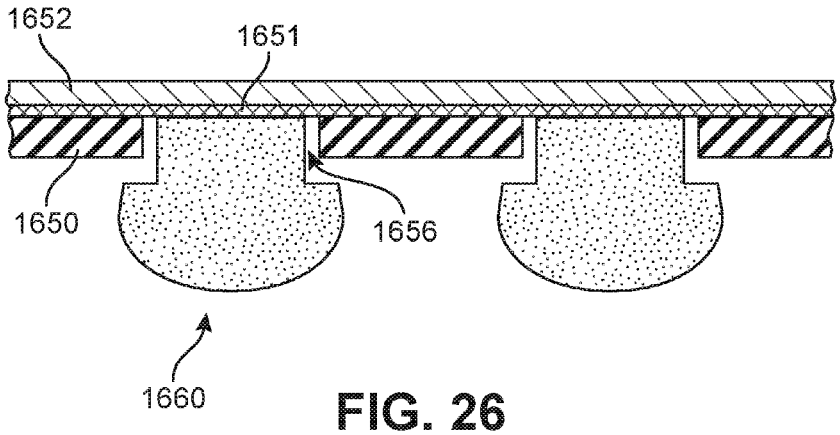
FIG. 26 is a schematic view of another gluing configuration for components of a sole system, according to an embodiment, with sensory node elements in a neutral state.
Figure 27:
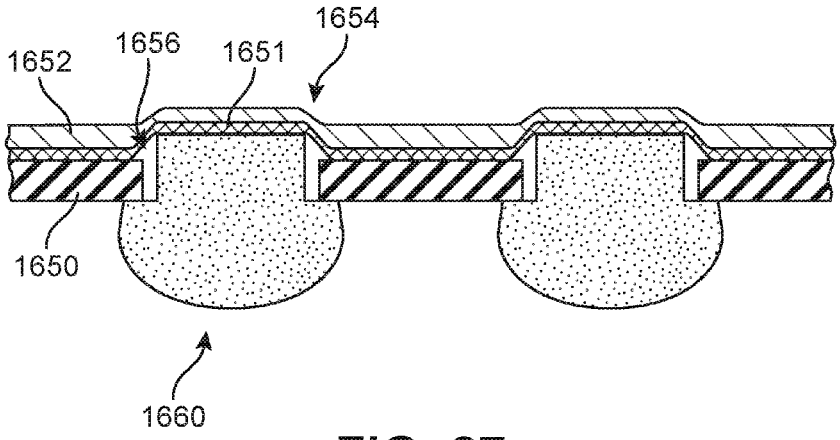
FIG. 27 is a schematic view of the components of the sole system of FIG. 26, with sensory node elements in a loaded state.

Alternatively, in another embodiment, an article can be provided with a relatively flexible inner foot-receiving layer (e.g., insole or lower layer of an upper). Such a configuration is illustrated schematically in FIGS. 26 and 27. Referring to FIGS. 26 and 27, a flexible inner foot receiving layer 1652 is attached (e.g., glued or otherwise fused via bonding layer 1651) to the entire inner surface of carrier member 1650 as well as the top surface of sensory node elements 1660. As sensory node elements 1660 are pressed into an interior of the article, inner foot receiving layer 1652 stretches at portions 1654 immediately adjacent the edge of recesses 1656. This allows the sensory node elements to move relative to the carrier member. Exemplary materials that could be used include layers with neoprene, spandex, etc.

Embodiments could also include one or more weather-proofing provisions. For example, in some embodiments a layer such as layer 1651 in FIGS, 26 and 27 could be a weather-proofing layer. In some embodiments, layer 1651 could be both a bonding layer and weather-proofing layer.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. An article of footwear with an upper and a sole system, the sole system comprising:

a plurality of sensory node elements including a first sensory node element and a second sensory node element, the first sensory node element having a first bottom end configured to contact a ground surface and a first top end disposed opposite the first bottom end and the second sensory node element having a second bottom end configured to contact the ground surface and a second top end disposed opposite the second bottom end;

a carrier member for the plurality of sensory node elements, the carrier member including a plurality of recesses, wherein the plurality of recesses includes a first recess corresponding with the first top end of the first sensory node element, and wherein the plurality of recesses includes a second recess corresponding with the second top end of the second sensory node element;

wherein the first top end of the first sensory node element has a smaller diameter than the first bottom end;

wherein the second top end of the second sensory node element has the smaller diameter than the second bottom end;

wherein the first recess is spaced apart from the second recess;

wherein the first sensory node element can tilt about a first central axis of the first recess and wherein the second sensory node element can tilt about a second central axis of the second recess, and wherein the first sensory node element and the second sensory node element are attached to an inner foot-receiving layer that is attached to an upper.

2. The article of footwear according to claim 1, wherein the first recess is disposed adjacent to the second recess.

3. The article of footwear according to claim 1, wherein the first sensory node element is disposed adjacent to the second sensory node element.

4. The article of footwear according to claim 1, wherein the plurality of sensory node elements includes a third sensory node element and wherein the third sensory node element is permanently attached to the carrier member.

5. The article of footwear according to claim 1, wherein:

the plurality of sensory node elements includes a third sensory node element having a diameter that is less than the diameters of the first and second sensory node elements; and wherein a distance between any two adjacent sensory node elements in the plurality of sensory node elements is less than the diameter of the third sensory node element.

6. An article of footwear, comprising:

a sole structure including a plurality of sensory node elements and a carrier member for the plurality of sensory node elements;

the plurality of sensory node elements including a first sensory node element and a second sensory node element, the first sensory node element having a first bottom end configured to contact a ground surface and a first top end disposed opposite the first bottom end and the second sensory node element having a second bottom end configured to contact the ground surface and a second top end disposed opposite the second bottom end;

the carrier member including a plurality of recesses, wherein the plurality of recesses includes a first recess corresponding with the first top end of the first sensory node element, and wherein the plurality of recesses includes a second recess corresponding with the second top end of the second sensory node element;

wherein the first top end of the first sensory node element has the smaller diameter than the first bottom end; and wherein the second top end of the second sensory node element has the smaller diameter than the second bottom end;

an inner foot receiving layer; and wherein the carrier member is located between the inner foot receiving layer and the plurality of sensory node elements, wherein the plurality of sensory node elements are attached to the inner foot-receiving layer.

7. The article of footwear according to claim 6, wherein:

the first recess is spaced apart from the second recess; and wherein the first sensory node element can tilt about a first central axis of the first recess and wherein the second sensory node element can tilt about a second central axis of the second recess.

8. The article of footwear according to claim 6, wherein the inner foot receiving layer is an insole.

9. The article of footwear according to claim 6, wherein the article of footwear includes an upper and wherein the inner foot-receiving layer is part of the upper.

10. The article of footwear according to claim 6, wherein the inner foot-receiving layer is a flexible layer and the first sensory node element is movable between a first configuration and a second configuration;

wherein in the first configuration a top surface of the first top end of the first sensory node element is flush with an inner surface of the carrier member at a portion of the carrier member that is adjacent the first recess; and wherein in the second configuration the first top end of the first sensory node element is pushed into the inner foot-receiving layer by the contact with the ground surface so that the top surface of the first top end is spaced apart from the inner surface of the carrier member by a first distance.

11. The article of footwear according to claim 10, wherein in the first configuration the top surface of the second top end of the second sensory node element is flush with the inner surface of the carrier member at the portion of the carrier member that is adjacent the second recess;

wherein in the second configuration the second top end of the second sensory node element is pushed into the inner foot receiving layer so that the top surface of the second top end is spaced apart from the inner surface of the carrier member by a second distance; and wherein the first distance is different than the second distance.

12. The article of footwear according to claim 11, wherein:

the inner foot receiving layer has the inner surface and an outer surface opposite the inner surface, the inner surface being disposed further from the plurality of sensory node elements than the outer surface; and wherein the inner surface of the inner foot-receiving layer has a first surface geometry in the first configuration and a second surface geometry in the second configuration that is different from the first surface geometry.

13. The article of footwear according to claim 12, wherein the first surface geometry is smoother than the second surface geometry.

14. An article of footwear, comprising:

a sole structure including a plurality of sensory node elements and a carrier member for the plurality of sensory node elements;

the plurality of sensory node elements including a first sensory node element and a second sensory node element, the first sensory node element having a first bottom end configured to contact a ground surface and a first top end disposed opposite the first bottom end and the second sensory node element having a second bottom end configured to contact the ground surface and a second top end disposed opposite the second bottom end;

wherein the first top end of the first sensory node element has a smaller diameter than the first bottom end and wherein the second top end of the second sensory node element has the smaller diameter than the second bottom end;

the carrier member including a base portion with a plurality of recesses, wherein the plurality of recesses includes a first recess corresponding with the first top end of the first sensory node element, the first recess having a first opening that extends through a top surface of the carrier member, and wherein the plurality of recesses includes a second recess corresponding with the second top end of the second sensory node element, the second recess having a second opening that extends through the top surface of the carrier member;

wherein the first top end and second top end are attached to a flexible foot-receiving layer that, upon contact with the ground surface by the first and second bottom ends, flexes to allow the first top end to move through the first opening and the second top end to move through the second opening; and the carrier member further including a side portion extending from a perimeter of the base portion, the side portion varying in height in a repetitive manner.

15. The article of footwear according to claim 14, wherein the side portion restricts lateral motion of the first sensory node element.

16. The article of footwear according to claim 14, wherein the carrier member is made of a first material with a first elastic modulus and the first sensory node element is made of a second material with a second elastic modulus, wherein the first elastic modulus is greater than the second elastic modulus.

17. The article of footwear according to claim 14, wherein the carrier member is made of a first material having a first density, wherein the first sensory node element is made of a second material having a second density and wherein the first density is greater than the second density.

18. The article of footwear according to claim 14, wherein the first sensory node element includes a raised portion with a circular cross-sectional shape and wherein the first recess has a corresponding circular shape.

* * * * *